US005650264A

United States Patent [19]

Kawai et al.

[11] Patent Number: 5,650,264

[45] Date of Patent: *Jul. 22, 1997

[54] METHOD FOR FORMING AN IMAGE ON A SILVER HALIDE COLOR PHOTOGRAPHIC MATERIAL

[75] Inventors: Kiyoshi Kawai; Mitsuo Saito, both of Minami - ashigara, Japan

[73] Assignee: Fuji Photo Film Co., Ltd., Minami-ashigara, Japan

[ * ] Notice: The term of this patent shall not extend beyond the expiration date of Pat. No. 5,449,596.

[21] Appl. No.: 593,174

[22] Filed: Feb. 1, 1996

Related U.S. Application Data

[63] Continuation of Ser. No. 219,369, Mar. 29, 1994, abandoned.

[30] Foreign Application Priority Data

Apr. 2, 1993 [JP] Japan ..... 5-100245
Oct. 5, 1993 [JP] Japan ..... 5-271232

[51] Int. Cl.[6] ..... G03C 5/00

[52] U.S. Cl. ..... 430/398; 430/400; 430/567; 430/569

[58] Field of Search ..... 430/398, 400, 430/567, 569

[56] References Cited

U.S. PATENT DOCUMENTS

| | | | |
|---|---|---|---|
| 5,234,801 | 8/1993 | Ishikawa | 430/398 |
| 5,250,396 | 10/1993 | Ueda et al. | 430/398 |
| 5,264,337 | 11/1993 | Maskasky | 430/567 |
| 5,275,930 | 1/1994 | Maskasky | 430/567 |
| 5,314,798 | 5/1994 | Brust et al. | 430/567 |
| 5,320,938 | 6/1994 | House et al. | 430/567 |
| 5,342,740 | 8/1994 | Goto et al. | 430/400 |
| 5,356,764 | 10/1994 | Szajewski et al. | 430/567 |
| 5,449,596 | 9/1995 | Kawai et al. | 430/508 |

FOREIGN PATENT DOCUMENTS

| | | |
|---|---|---|
| 534395A | 3/1993 | European Pat. Off. . |
| 584644A | 3/1994 | European Pat. Off. . |
| 70741 | 3/1989 | Japan . |
| 32 | 1/1990 | Japan . |

*Primary Examiner*—Thorl Chea
*Attorney, Agent, or Firm*—Burns, Doane, Swecker & Mathis

[57] ABSTRACT

There is disclosed a method for forming an image by processing a silver halide color photographic material having at least one silver halide emulsion layer on a support, wherein at least one layer of the silver halide emulsion layers of said color photographic material comprises silver halide grains which is high in silver chloride content and whose silver chloride content is 80 mol % or more; said silver halide grains are tabular silver halide grains having (100) planes as main planes; and said color photographic material is processed with the replenishment rate of a replenisher having a bleaching capacity in a desilvering step being 150 ml or less per $m^2$ of the photographic material. The method for forming an image on a silver halide color photographic material of the present invention is excellent in delivering characteristics, even when the replenishment rate of bleach-fix solution is reduced remarkably.

15 Claims, No Drawings

METHOD FOR FORMING AN IMAGE ON A SILVER HALIDE COLOR PHOTOGRAPHIC MATERIAL

This application is a divisional of application Ser. No. 08/219,369. filed Mar. 29, 1994 now abandoned.

FIELD OF THE INVENTION

The present invention relates to a method for forming an image on a silver halide color photographic material (hereinafter referred to simply as a photographic material in some cases). Particularly the present invention relates to a photographic processing method excellent in desilvering characteristics.

BACKGROUND OF THE INVENTION

Processing of a silver halide color photographic material basically comprises two steps: a color-developing step and a desilvering step. The desilvering step comprises a bleaching step and a fixing step or comprises a monobath bleach-fix step, that is used in combination with them or singly. If necessary, in addition thereto, an additional processing step, such as a washing step, a stop-processing step, a stabilizing step, and a pre-processing for the acceleration of development, is added.

In recent years, reduction in the replenishment rate of a bleach-fix solution and reduction in the amount of waste liquor are strongly desired for the purpose of making bleach-fix processing rapid, reducing environmental pollution, saving resources, and reducing cost. However, reduction in the replenishment rate and reduction in the amount of waste liquor have not actually been practically achieved. This is mainly because the reduction in the replenishment rate makes the dwell time of the solution long, which increases the concentration of silver ions that accumulate in the solution due to the desilvering reaction, or it increases the mixed ratio of the color developer, with results in both cases that the desilvering characteristics drops.

It is known that, generally, when a silver halide emulsion high in silver chloride content is used, the development or fixing can be attained in a short period of time, so that a silver halide photographic material suitable for rapid processing can be obtained. However, it is actually impossible to make the replenishment rate as extremely low as 150 ml per $m^2$ of the photographic material in a desilvering step.

On the other hand, Japanese Patent Application (OPI) No. Hei. 2-32 (1990) describes that the development can be made rapid by using a high-silver-chloride emulsion having (111) planes. Further Japanese Patent Application (OPI) No. Sho. 64-70741 (1989) describes that a desilvering step is carried out rapidly. However, since grains having (111) planes have such a defect that adsorption of dyes is weak, they cannot practically be used under present conditions in view, for example, of preservability.

SUMMARY OF THE INVENTION

Therefore, an object of the present invention is to provide a method for forming an image on a photographic material, in which method, when a photographic material excellent in preservability is used, and even when the replenishment rate of a solution having a bleaching capacity is reduced remarkably, good desilvering characteristics are exhibited.

Other objects, features, and advantages of the present invention will become apparent from the following description.

DETAILED DESCRIPTION OF THE INVENTION

To the above problems, studies have been made and it was found that the above objects can be attained by processing using the following photographic material:

(1) A method for forming an image by processing a silver halide color photographic material having at least one silver halide emulsion layer on a support, in which at least one layer of the silver halide emulsion layers of said color photographic material comprises silver halide grains which is high in silver chloride content and whose silver chloride content is 80 mol % or more; said silver halide grains are tabular silver halide grains having (100) planes as main planes; and said color photographic material is processed with the replenishment rate of a replenisher having a bleaching capacity in a desilvering step being 150 ml or less per $m^2$ of the photographic material;

(2) The method for forming an image as stated in the above (1), in which the tabular grains having (100) planes as main planes and an aspect ratio (diameter/thickness) of 1.5 or more occupy 35% or more of the total of projected areas of the whole silver halide emulsion grains in the silver halide emulsion layer comprising high-silver-chloride grains whose silver chloride content is 80 mol % or more, and the center portion of said tabular grains has at least one gap phase discontinuous in halogen composition, said gap being a difference of 10 to 100 mol % in $Cl^-$ content or $Br^-$ content and/or a difference of 5 to 100 mol % in $I^-$ content;

(3) The method for forming an image as stated in the above (2), in which the center portion of said tabular silver halide grains has at least one gap phase discontinuous in halogen composition, the gap being a difference of 30 to 100 mol % in $Cl^-$ content or $Br^-$ content; and (4) The method for forming an image as stated in the above (1), (2), or (3), in which said silver halide color photographic material is exposed to light in such a scanning exposure manner that the exposure time per picture element is shorter than $10^{-4}$ second.

Now the present invention is described in detail below.

First, the solution having a bleaching capacity of the present invention is described.

The bleaching processing may be carried out together with the fixing processing (bleach-fix processing), or it may be carried out separately. Further, to make the processing rapid, bleach-fix processing may be carried out after the bleaching processing. Further, depending on the purpose, it is arbitrary that the processing is carried out using two continuous bleach-fix baths; that the fixing is carried out before the bleach-fix; or that the bleaching is carried out after the bleach-fix. As the bleaching agent, for example, compounds of polyvalent metals, such as iron (III), cobalt (III), chromium (IV), and copper (II), peracids, quinones, and nitro compounds can be used. As typical bleaching agents, can be used, for example, ferricyanades; dichromates; organic complex salts of iron (III) or cobalt (III), for example, aminopolycarboxylic acids, such as ethylenediaminetetraacetic acid, diethylenetriaminepentaacetic acid, cyclohexadiamine-tetraacetic acid, methyliminodiacetic acid, 1,3-diaminopropanetetraacetic acid, and glycol ether diaminetetraacetic acid, or complex salts of malic acid, tartaric acid, citric acid, etc.; persulfates; bromates; permanganates; and nitrobenzenes. Out of these, iron(III) aminopolycarboxylate complex salts including iron(III) ethylenediaminetetraacetate complex and persulfates are preferred in view of the prevention of environmental pollution. Further, iron(III) aminopolycarboxylates complex salts are particularly useful in the bleaching solution as well as the bleach-fix solution.

In the bleaching solution, the bleach-fix solution, and the bath preceding them, a bleach accelerator can be used if necessary. Specific examples of useful bleach accelerators are compounds having a mercapto group or a disulfide bond described, for example, in U.S. Pat. No. 3,893,858, West German Patent No. 1,290,812, Japanese Patent Publication No. Sho. 53-95630 (1978), and Research Disclosure No. 17129 (July, 1978); thiazolizine derivatives described in Japanese Patent Application (OPI) No. Sho. 50-140129 (1975); thiourea derivatives described in U.S. Pat. No. 3,706,561; iodide salts described in Japanese Patent Application (OPI) No. Sho. 58-16235 (1983); polyoxyethylene compounds described in West German Patent No. 2,748,430; polyamine compounds described in Japanese Patent Publication No. Sho. 45-8836 (1970); and bromide ions. Among them, compounds having a mercapto group or a disulfide group are preferred because the accelerating effect is great and particularly compounds described in U.S. Pat. No. 3,893,858, West German Patent No. 1,290,812, and Japanese Patent Application (OPI) No. Sho. 53-95630 (1978) are preferred. Further, compounds described in U.S. Pat. No. 4,552,832 are also preferable. These bleach accelerators may be added into the photographic material.

The concentration of the bleaching agent in the solution having a bleaching capacity of the present invention is suitably in the range of 0.005 to 1.0 mol/liter, preferably 0.01 to 0.70 mol/liter, and more preferably 0.02 to 0.50 mol/liter.

The concentration of the bleaching agent in the replenisher is preferably 0.005 to 2 mol/liter, more preferably 0.01 to 1.0 mol/liter.

In the present invention, the solution having a bleaching capacity includes, for example, a bleach-fix solution and a bleaching solution.

Now, the desilvering step that can be applied to the present invention is described. The desilvering step that can be applied to the present invention includes, for example, a bleach/fixing step, a bleach-fixing step, a bleach/bleach-fixing step, a bleach-fixing step/fixing step, and a bleaching step/bleach-fixing step/fixing step. In the present invention, it is preferable that a bleach-fixing step is carried out singly with a view to making the desilvering step simple and rapid.

In addition, the bleaching solution or the bleach-fix solution that can be applied to the present invention can contain a rehalogenizing agent, such as a bromide (e.g., potassium bromide, sodium bromide, ammonium bromide), a chloride (e.g., potassium chloride, sodium chloride, and ammonium chloride), and an iodide (e.g., ammonium iodide). If required, for example, one or more of inorganic acids and organic acids having a pH buffering capacity, their alkali salts and ammonium salts, such as borax, sodium metaborate, acetic acid, sodium acetate, sodium carbonate, potassium carbonate, phosphorous acid, phosphoric acid, sodium phosphate, citric acid, sodium citrate, and tartaric acid, and a corrosion inhibitor, such as ammonium nitrate and guanidine, can be added.

Further, the bleach-fix solution and the bleaching solution can contain other various fluorescent whitening agents, antifoaming agents, or surface-active agents, polyvinyl pyrrolidones, and organic solvents, such as methanol.

The fixing agent that is used in the bleach-fix solution or the fixing solution includes known fixing agents, i.e., water-soluble silver halide solvents, for example, thiosulfates, such as sodium thiosulfate and ammonium thiosulfate; thiocyanates, such as sodium thiocyanate and ammonium thiocyanate; thioether compounds, such as ethylenebisthioglycolic acid and 3,6-dithia-1,8-octanediol, and thioureas, which can be used alone or as a mixture of two or more. Further, for example, a special bleach-fix solution comprising a combination of a fixing agent and a large amount of a halide, such as a potassium iodide, described in Japanese Patent Application (OPI) No. Sho. 55-155354 (1980) can be used. In the present invention, use of a thiosulfate, particularly ammonium thiosulfate, is preferable. The amount of the fixing agent per liter is preferably in the range of 0.3 to 2 mol, more preferably 0.5 to 1.0 mol.

Preferably the bleach-fix solution and the fixing solution contain, as a preservative, a sulfite ion releasing compound, such as a sulfite (e.g., sodium sulfite, potassium sulfite, and ammonium sulfite), a bisulfite (e.g., ammonium bisulfite, sodium bisulfite, and potassium bisulfite), a metabisulfite (e.g., potassium metabisulfite, sodium metabisulfite, and ammonium metabisulfite). These compounds are contained preferably in an amount of about 0.02 to 0.50 mol/liter, more preferably 0.04 to 0.40 mol/liter, in terms of sulfite ions.

As the preservative to be added to the bleach-fix solution and the fixing solution, a sulfite is generally used, but, for example, ascorbic acid, a carbonyl bisulfite-addition compound, or a carbonyl compound can also be used and benzenesulfinic acids are also effective. Further, to the bleach-fix solution and the fixing solution may be added, for example, a buffer, a fluorescent whitening agent, a chelating agent, an antifoaming agent, and a mildewproofing agent, if necessary.

In the present invention, particularly preferably the bleach-fix solution and the bleaching solution is substantially free from ammonium ions in view of the prevention of deposition and the improvement of adhesion of the photographic material after the processing. The term "substantially free from ammonium ions" means that the amount of ammonium ions is 0.1 mol/liter or less, more preferably 0.05 mol/liter or less, and most preferably not contained at all.

In the bleach-fix solution or the bleaching solution of the present invention, a preferable pH range is 3 to 10, more preferably 4 to 9.

In particular, when a high-silver-chloride emulsion is used in the photographic material, the pH of the bleach-fix solution or the bleaching solution is preferably 9.0 to 4.0, more preferably 8.0 to 4.0, and particularly preferably 6.5 to 4.5.

The replenishment rate to the bath having a bleaching capacity of the present invention is 150 ml or less, preferably 20 to 150 ml, particularly preferably 25 to 100 ml, and further more preferably 30 to 50 ml, per $m^2$ of the photographic material.

The processing temperature of the bleach-fix solution or the bleaching solution that can be applied to the present invention is 20° to 50° C., preferably 30° to 40° C. The processing time is 5 seconds to 5 minutes, preferably 10 seconds to 2 minutes.

Now, the color development for use in the present invention is described.

The color developer for use in the present invention contains known aromatic primary amine color-developing agent. Preferred examples are p-phenylenediamine derivatives, and as representative examples thereof can be mentioned N,N-diethyl-p-phenylenediamine, 2-amino-5-diethylaminotoluene, 2-amino-5-(N-ethyl-N-laurylamino) toluene, 4-[N-ethyl-N-(β-hydroxyethyl)amino]aniline, 2-methyl-4-[N-ethyl-N-(β-hydroxyethyl)amino]aniline, 4-amino-3-methyl-N-ethyl-N-[β-(methanesulfonamido) ethyl]aniline, N-(2-amino-5-diethyl-aminophenylethyl) methanesulfonamide, N,N-dimethyl-p-phenylenediamine, 4-amino-3-methyl-N-ethyl-N-β-metoxyethylaniline, 4-amino-3-methyl-N-ethyl-N-β-ethoxyethylaniline, and 4-amino-3-methyl-N-ethyl-N-β-butoxyethylaniline. Particularly preferable is 4-amino-3-methyl-N-ethyl-N-[β-(methanesulfonamido)ethyl]aniline.

Further, these p-phenylenediamine derivatives may be in the form of salts such as sulfates, hydrochlorides, sulfites, and p-toluenesulfonates. The amount of said aromatic primary amine developing agent to be used is generally about 4 mmol to 50 mmol per liter of color developer, and the amount to be used for replenisher of color developer is preferably in a concentration of about 21 mmol to 45 mmol, more preferably about 23 mmol to 40 mmol, per liter of replenisher. The method according to the present invention is particularly effective when a concentrated replenisher of color developer is used.

In practicing the present invention, it is preferable to use a color developer substantially free from benzyl alcohol, in view of working circumstance. Herein the term "substantially free from" means that the concentration of benzyl alcohol is preferably 2.0 ml/liter or less, more preferably 0.5 ml/liter or less, and most preferably benzyl alcohol is not contained at all.

It is more preferable that the color developer for use in this invention is substantially free from sulfite ions (herein "substantially free from" means that the concentration of sulfite ions is $3.0\times10^{-3}$ mol/liter or below), in order to suppress the variation of photographic properties due to the continuous processing. Most preferably sulfite ion is not contained at all. However, in the present invention, a little amount of sulfite ions contained in a processing agents kit wherein the developing agent has been concentrated before preparing solution to be used, in order to prevent the oxidation of agents, is excluded.

Preferably, the color developer for use in the present invention is substantially free from sulfite ions, and more preferably, it is substantially free from hydroxylamine (herein "substantially free from hydroxylamine" means that the concentration of hydroxylamine is $5.0\times10^{-3}$ mol/liter or less), in order to suppress the variation of photographic properties due to the changing of concentration of hydroxylamine. Most preferably hydroxylamine is not contained at all.

It is more preferable that the color developer for use in the present invention contains an organic preservatives instead of above-described hydroxylamine or sulfite ions.

Herein the term "organic preservatives" refers to organic compounds that generally, when added to the processing solution for the color photographic material, reduce the speed of deterioration of the aromatic primary amine color-developing agent. That is, organic preservatives include organic compounds having a function to prevent the color developing agent from being oxidized, for example, with air, and in particular, hydroxylamine derivatives (excluding hydroxylamine), hydroxamic acids, hydrazines, hydrazides, phenols, α-hydroxyketones, α-aminoketones, saccharides, monoamines, diamines, polyamines, quaternary ammonium salts, nitroxy radicals, alcohols, oximes, diamide compounds, and condensed cyclic amines are effective organic preservatives. These are disclosed, for example, Japanese Patent Publication No. Sho. 48-30496 (1973), Japanese Patent Application (OPI) Nos. Sho. 52-143020 (1977), Sho. 63-4235 (1988), Sho. 63-30845 (1988), Sho. 63-21647 (1988), Sho. 63-44655 (1988), Sho. 63-53551 (1988), Sho. 63-43140 (1988), Sho. 63-56654 (1988), Sho. 63-58346 (1988), Sho. 63-43138 (1988), Sho. 63-146041 (1988), Sho. 63-44657 (1988), and Sho. 63-44656 (1988), U.S. Pat. Nos. 3,615,503 and 2,494,903, and Japanese Patent Application (OPI) Nos. Hei. 1-97953 (1989), Hei. 1-186939 (1989), Hei. 1-186940 (1989), Hei. 1-187557 (1989), and Hei. 2-306422 (1990). As the other preservatives, various metals described in Japanese Patent Application (OPI) Nos. Sho. 57-44148 (1982) and Sho. 57-53749 (1982), salicylic acids described in Japanese Patent Application (OPI) No. Sho. 58-180588 (1984), amines described in Japanese Patent Application (OPI) Nos. Sho. 63-239447 (1988), Sho. 63-128340 (1988), Hei. 1-186939 (1989), and Hei. 1-187557 (1989), alkanol amines described in Japanese Patent Application (OPI) No. Sho. 54-3532 (1979), polyethyleneimines described in Japanese Patent Application (OPI) No. Sho. 56-94349 (1981), and aromatic polyhydroxyl compounds described in U.S. Pat. No. 3,746,544 may be included, if needed. It is particularly preferable the addition of alkanolamines, such as triethanolamine, dialkylhydroxylamines, such as N,N-diethylhydroxylamine and N,N-di(sulfoethyl)hydroxyl-hydrazine derivatives (excluding hydrazine), such as N,N-bis(carboxymethyl) hydrazine, or aromatic polyhydroxy compounds, such as sodium catechol-3,5-disulfonate.

In particular, the use of alkanolamines in combination with dialkylhydroxylamine and/or hydrazine derivatives is more preferable in view of stability improvement of the color developer resulting its stability-improvement during the continuous processing.

In the present invention, the color developer preferably contains chloride ions in an amount of $3.0\times10^{-2}$ to $1.5\times10^{-1}$ mol/liter, particularly preferably $3.5\times10^{-2}$ to $1\times10^{-1}$ mol/liter. When the concentration of chloride ions is much than $1.5\times10^{-1}$ mol/liter, it is not preferable because of defect to retard the developing. Further, when being less than $3.0\times10^{-2}$ mol/liter, it is not preferable for preventing fogging.

In the present invention, the color developer preferably contains bromide ions in an amount of $3.0\times10^{-5}$ mol/liter to $1.0\times10^{-3}$ mol/liter, more preferably $5.0\times10^{-5}$ to $5\times10^{-4}$ mol/liter. When the concentration of bromide ions exceeds $1\times10^{-3}$ mol/liter, developing is retarded, resulting maximum density and sensitivity being lowered, and when the concentration is less than $3.0\times10^{-5}$ mol/liter, fogging cannot be prevented sufficiently.

Herein, chloride ions and bromide ions may be added directly to the color developer, or they may be allowed to dissolve out from the photographic material to the color developer at the development processing.

If chloride ions are added directly to the color developer, as the chloride ion-supplying material can be mentioned sodium chloride, potassium chloride, ammonium chloride, lithium chloride, magnesium chloride, and calcium chloride. Further, they may be supplied from a fluorescent brightening agent that is added to the color developer.

As the bromide ion-supplying material can be mentioned sodium bromide, potassium bromide, ammonium bromide, lithium bromide, calcium bromide, and magnesium bromide.

When chloride ions and bromide ions are allowed to dissolve out from the photographic material in the color developer, both the chloride ions and bromide ions may be supplied from the emulsion or a source other than the emulsion.

Preferably the pH of the color developer to be used in the present invention is in the range of 9 to 12, more preferably 9 to 11.0, and other known compounds that are components of a conventional developing solution can be contained in the color developing solution.

In order to keep the above pH, it is preferable to use various buffers. As buffers, use can be made, for example, carbonates, phosphates, borates, tetraborates, hydroxylbenzoates, glycyl salts, N,N-dimathylglycinates, leucinates, norleucinates, guanine salts, 3,4-dihydroxyphenylalanine salts, alanine salts, aminobutyrates, 2-amino-2-methyl-1,3-propandiol salts, valine salts, proline salts, trishydroxyaminomethane salts, and lysine salts. It is particularly preferable to use carbonates, phosphates, tetraborates, and hydroxybenzoates as buffers, because they have advantages that they are excellent in solubility and in buffering function in the high pH range of a pH 9.0 or higher, they do not adversely affect the photographic function (for example, to cause fogging) if they are added to a color developer, and they are inexpensive.

As specified examples of buffer, there are included sodium carbonate, potassium carbonate, sodium bicarbonate, potassium bicarbonate, trisodium phosphate, tripotassium phosphate, disodium phosphate, dipotassium phosphate, sodium borate, potassium borate, sodium tetraborate (borax), potassium tetraborate, sodium o-hydroxybenzoate (sodium salicylate), potassium o-hydroxybenzoate, sodium 5-sulfo-2-hydroxybenzoate (sodium 5-sulfosalicylate), and potassium 5-sulfo-2-hydroxybenzoate (potassium 5-sulfosalicylate).

The amount of buffer to be added to the color developer is preferably 0.1 mol/liter or more, and particularly preferably 0.1 to 0.4 mol/liter.

In addition to the color developer can be added various chelating agents to prevent calcium or magnesium from precipitating or to improve the stability of the color developer. Specific examples are shown below: nitrilotriacetic acid, diethylenetriaminepentaacetic acid, ethylenediaminetetraacetic acid, N,N,N-trimethylenephosphonic acid, ethylenediamine-N,N,N',N'-tetramethylenephosphonic acid, transcyclohexanediaminetetraacetic acid, 1,2-diaminopropanetetraacetic acid, glycol ether diaminetetraacetic acid, ethylenediamineorthohydroxyphenylacetic acid, 2-phosphonobutane-1,2,4-tricarboxylic acid, 1-hydroxyethylidene-1,1-diphosphonic acid, N,N'-bis(2-hydroxybenzyl)ethylenediamine-N,N'-diacetic acid, hydroxyethyliminodiacetic acid. If necessary, two or more of these chelating agents may be used together.

With respect to the amount of these chelating agents to be added, it is good if the amount is enough to sequester metal ions in the color developer. The amount, for example, is on the order of 0.1 g to 10 g per liter.

If necessary, any development accelerator can be added to the color developer.

As development accelerators, the following can be added as desired: thioether compounds disclosed, for example, in Japanese Patent Publication Nos. Sho. 37-16088 (1962), Sho. 37-5987 (1962), Sho. 38-7826 (1963), Sho. 44-12380 (1969), and Sho.45-9019 (1970), and U.S. Pat. No. 3,813, 247; p-phenylenediamine compounds disclosed in Japanese Patent Application (OPI) Nos. Sho. 52-49829 (1977) and Sho. 50-15554 (1975); quaternary ammonium salts disclosed, for example, in Japanese Patent Application (OPI) No. Sho. 50-137726 (1975), Japanese Patent Publication No. Sho. 44-30074 (1969), and Japanese Patent Application (OPI) Nos. Sho. 56-156826 (1981) and Sho. 52-43429 (1977); amine compounds disclosed, for example, in U.S. Pat. Nos. 2,494,903, 3,128,182, 4,230,796, and 3,253,919, Japanese Patent Publication No. Sho. 41-11431 (1966), and U.S. Pat. Nos. 2,482,546, 2,596,926, and 3,582,346; polyalkylene oxides disclosed, for example, in Japanese Patent publication Nos. Sho. 37-16088 (1962) and Sho. 42-25201 (1967), U.S. Pat. No. 3,128,183, Japanese Patent Publication Nos. Sho. 41-11431 (1966) and Sho. 42-23883 (1967), and U.S. Pat. No. 3,532,501; 1-phenyl-3-pyrazolidones, and imidazoles. With respect to benzyl alcohol, the same as the above described is applied.

In the present invention, if necessary, any antifoggant can be added. As antifoggants, use can be made of alkali metal halides, such as sodium chloride, potassium bromide, and potassium iodide, and organic antifoggants. As typical organic antifoggants can be mentioned, for example, nitrogen-containing heterocyclic compounds, such as benzotriazole, 6-nitrobenzimidazole, 5-nitroisoindazole, 5-methylbenzotriazole, 5-nitrobenzotriazole, 5-chlorobenzotriazole, 2-thiazolyl-benzimidazole, 2-thiazolylmethyl-benzimidazole, indazole, hydroxyazaindolizine, and adenine.

It is preferable that the color developer that is adaptable in the present invention contains a fluorescent brightening agent. As the fluorescent brightening agent, 4,4'-diamino-2, 2'-disulfostilbene compounds are preferable, which will be added in an amount of 0 to 5 g/liter, preferably 0.1 to 4 g/liter.

If required, various surface-active agents, such as alkylsulfonic acids, arylsulfonic acids, aliphatic carboxylic acids, aromatic carboxylic acids, and polyalkyleneimines may be added.

The processing temperature of the color developer adaptable to the present invention is 20° to 50° C., preferably 30° to 40° C. The processing time is 20 seconds to 5 minutes, and preferably 30 seconds to 2 minutes. Although it is preferable that the replenishing amount is as small as possible, it is suitable that the replenishing amount is 20 to 600 ml, preferably 30 ml to 200 ml, more preferably 30 ml to 150 ml, per $m^2$ of the photographic material.

The washing and/or stabilizing process for use in the present invention will be described.

In the present invention, after desilvering process, such as fixing or bleach-fix process, washing and/or stabilizing process is carried out.

The replenishment rate of washing process or stabilizing process per unit area of photographic material is 3 to 50 times, preferably 3 to 30 times, more preferably 3 to 10 times, carried over amount from preceding bath. When stabilizing treatment is carried out after washing, the method of the present invention is effective in a processing system wherein the replenisher rate of stabilizing process of the last process is 3 to 50 times carried over amount from the preceding bath. The replenishment may be carried out subsequently or intermittently. Solution that was used in washing and/or stabilizing process can be used in the preceding process. As example thereof can be mentioned a method wherein the overflowed washing solution of which amount is reduced by a multistage countercurrent system is flowed into the preceding bleach-fix bath, and a condensed solution is replenished to the bleach-fix bath, to reduce the waste solution.

The amount of washing water in the washing step can be set over a wide range, depending on the characteristics of the photographic material (e.g., the characteristics of the material used, such as couplers), the usage of the photographic material, the washing water temperature, the number of the washing water tanks (stages), the type of replenishing, such as the countercurrent type or of the down flow type, and other various conditions. Generally, the number of stages at the multistage countercurrent system is preferably 2 to 7, particularly preferably 2 to 6.

According to the multistage countercurrent system, the washing water amount can be reduced steeply, for example, 0.5 liter to 1 liter or less per $m^2$ of photographic material is possible, but such problems occur that bacteria propagate and the suspended matters formed adhere to the photographic material, because of retention time increasing of water in the tank. In order to solve these problems, the method for reducing calcium ions and magnesium ions, described in Japanese Patent Application (OPI) No. Sho. 62-288838 (1987), can be used quite effectively. Also, isothiazolone compounds and cyabendazoles described in Japanese Patent Application (OPI) No. Sho. 57-8542 (1982), chlorine-type disinfectant such as chlorinated sodium isocyanurate described in Japanese Patent Application (OPI) No. Sho. 61-120145 (1986), benzotriazoles described in Japanese Patent Application (OPI) No. Sho. 61-267761 (1986), copper ions, and other bactericides described by Hiroshi Horiguchi in "Bokin Bobai-zai no Kagaku", (1986) published by Sankyo-Shuppan, "Biseibutsu no Mekkin, Sakkin, Bobaigijutsu" (1982) edited by Eiseigijutsu-kai, published by Kogyo-Gijutsu-kai, and in "Bokin Bobaizai Jiten" (1986) edited by Nihon Bokin Bobai-gakkai, can be used.

Further, in washing water, surface-active agents as an water-draining agent and chelating agent represented by EDTA as a softening agent of water can be used.

Following to the above washing process or without washing process, a processing using directly a stabilizing solution can be carried out. In the stabilizing solution, compounds having image-stabilizing function such as, for example, aldehyde compounds represented by formalin, buffers to adjust the film pH suitable for image stabilization, and ammonium compounds, are added. Further, in order to prevent bacteria from propagating in solutions and to give antifungal property to the processed photographic material, the above described various pasteurizing agents and antifungal agents can be used.

Further, surface-active agents, fluorescent whitening agents, and film-hardening agents can be added. In the processing of the present invention, when the stabilization is carried out directly without washing process, all known methods described in, for example, Japanese Patent Application (OPI) Nos. Sho. 57-8543 (1982), Sho. 58-14834 (1983), and Sho. 60-220345 (1985).

As preferable modes, chelating agents such as 1-hydroxyethylidene-1,1-diphosphonic acid, ethylenediaminetetramethylenephospholic acid and the like, magnesium compounds and bismuth compounds are used.

The pH in the washing process or stabilizing process is 4 to 10, preferably 5 to 8. The temperature can be set according to the usage and characteristics of the photographic material, and it is generally 15° to 45° C., preferably 20° to 40° C. The time can be set arbitrarily, and the shorter the better in view of reduction of total processing time. It is preferably 15 seconds to 1 minute and 45 seconds, more preferably 30 seconds to 1 minute and 30 seconds.

Processing agents that can be applied to the present invention may be supplied as a concentrated solution consisting of one or plural parts, or it may be supplied as a powder. Further, they may be supplied in a state to use as it is, or a combination of concentrated solution, powder, and solution for use as it is.

The material of the replenishing cartridge into which the processing solution applied to the present invention is loaded may be any of paper, plastic, metal, etc., with preference given particularly to a plastic material having a coefficient of oxygen permeability of 50 ml ($m^2$·atm·day) or less. The coefficient of oxygen permeability can be measured by a method described by N. J. Calyan in "$O_2$ permeation of plastic container, Modern Packing," the December issue, pages 143 to 145 (1968).

As preferable plastic materials, specifically vinylidene (PVDC), nylon (NY), polyethylene (PE), polypropylene (PP), polyester (PES), ethylene/vinyl acetate copolymer (EVA), ethylene/vinyl alcohol copolymer (EVAL), polyacrylonitrile (PAN), polyvinylalcohol (PVA), and polyethylene terephthalate (PET) can be mentioned.

In the present invention, in order to reduce the oxygen permeability, PVDC, NY, PE, EVA, EVAL, and PET are preferably used.

These materials may be singly used to be molded or they may be formed into films, which are stuck together (to form a so-called composite film). As the shape of the container, various shapes of a bottle type, a cubic type, a pillow type, etc., can be used; and in the present invention a cubic type or similar structure, which is flexible and easy to handle and which can be reduced in its volume after its use is particularly preferable.

If the materials are used by forming them into a composite film, the following structures are preferable, but the present invention is not restricted to them.

PE/EVAL/PE
PE/Aluminum Foil/PE
NY/PE/NY
NY/PE/EVAL
PE/NY/PE/EVAL/PE
PE/NY/PE/PE/PE/NY/PE
PE/$SiO_2$ Film/PE
PE/PVDC/PE
PE/NY/Aluminum Foil/PE
PE/PP/Aluminum Foil/PE
NY/PE/PVDC/NY
NY/EVAL/PE/EVAL/NY
NY/PE/EVAL/NY
NY/PE/PVDC/NY/EVAL/PE
PP/EVAL/PE
PP/EVAL/PP
NY/EVAL/PE
NY/Aluminum Foil/PE
Paper/Aluminum Foil/PE
Paper/PE/Aluminum Foil/PE
PE/PVDC/NY/PE
NY/PE/Aluminum Foil/PE
PET/EVAL/PE
PET/Aluminum Foil/PE
PET/Aluminum Foil/PET/PE The thickness of the above composite films is of the order of 5 to 1,500 microns, preferably of the order of 10 to 1,000 microns. The internal volume of the completed container is of the order of 100 ml to 20 liters, preferably of the order of 500 ml to 10 liters.

The above container (cartridge) may have an outer box of corrugated board or plastic and may be formed by integrally molded with an outer box.

The cartridge of the present invention can be filled with various processing solutions. For example, a color developer, a black-and-white developer, a bleaching solution, a conditioner, a reversal solution, a fixing solution, a bleach-fix solution, and a stabilizing solution can be mentioned and particularly in the case of a cartridge whose oxygen permeability is low, a color developer, a black-and-white developer, a fixing solution, and a bleaching solution are preferably used.

The silver chloride content of the tabular silver halide grains having the (100) planes as main planes and a silver chloride content of 80 mol % or more for use in the present invention is preferably 90 mol % or more, most preferably 95 mol % or more.

The silver halide emulsion for use in the present invention comprises at least a dispersion medium and the above-described silver halide grains, and the tabular silver halide grains having the (100) planes as main planes occupy 10% or more, preferably 35 to 100%, and more preferably 60 to 100% based on the total of the projected areas of the whole silver halide grains in the emulsion. The projected areas used herein mean the projected areas of the grains when arranged on the substrate in the state that the silver halide emulsion grains do not overlap with one another, and in the state that the main planes are parallel to substrate planes for the tabular grains. The term "main planes" means two parallel maximum outer planes in one tabular grain. The aspect ratio (diameter/thickness) of the tabular grains is 1.5 or more, preferably 2 or more, more preferably 3 to 25, and further more preferably 3 to 7. Here, the term "diameter" is understood to be the diameter of a circle having the same area as the projected area of a grain observed under an electron microscope. Further, the term "thickness" means the distance between the main planes of the tabular grain. The diameter of the tabular silver halide grains is preferably 10 μm or less, more preferably 0.2 to 5 μm, and further more preferably 0.2 to 3 μm. The thickness is preferably 0.7 μm or less, more preferably 0.03 to 0.3 μm, and further more preferably 0.05 to 0.2 μm. The grain size distribution of the tabular grains is preferably monodisperse and the coefficient of variation is preferably 40% or less, and more preferably 20% or less.

The tabular silver halide grains having the (100) planes as main planes and a silver chloride content of 80 mol % or more in the present invention can also be prepared by the method described in European Patent 0534395A1, page 7, line 53 to page 19, line 35, or Japanese Patent Application No. Hei. 4-214109 (1992), paragraph Nos. 0006 to 0024. However, all of these grains have no gap phase discontinuous in halogen composition in the center portions, and are of the uniform halogen composition type or of the gently changing halogen composition type. In this case, it is difficult to produce the tabular grains so as to have the required properties, which occasionally causes production variations. Further, the size distribution becomes broad, so that the sensitivity, gradation, granularity, etc. are unsuitable in image quality in some cases.

In order to solve such problems, it is preferred that the grains have the gap phases discontinuous in halogen composition in the center portion thereof. The grain contains at least one gap phase discontinuous in halogen composition, preferably 2 to 4 gap phases, and more preferably 2 gap phases.

1) Concrete Examples when the Grain has One Gap Phase Discontinuous in Halogen Composition An AgCl nucleus is laminated with AgBr (AgCl/AgBr), AgCl is laminated with AgBrI (AgCl/AgBrI), and AgClBr is laminated with AgBr (AgClBr/AgBr). More generally, they are expressed by ($AgX_1/AgX_2$), wherein $X_1$ is different from $X_2$ in $Cl^-$ content or $Br^-$ content by 10 to 100 mol %, preferably 30 to 100 mol %, more preferably 50 to 100 mol %, further more preferably 70 to 100 mol %. In addition to the above-described differences in $Cl^-$ content or $Br^-$ content, or singly, the difference in $I^-$ content is 5 to 100 mol %, preferably 10 to 100 mol %, more preferably 30 to 100 mol %, and further more preferably 50 to 100 mol %.

2) Concrete Examples when the Grain has Two Gap Phases Discontinuous in Halogen Composition Examples represented by the above-mentioned description include (AgBr/AgCl/AgBr), (AgCl/AgBr/AgI), (AgBrI/AgCl/AgBrI), and (AgCl/AgClBr/AgCl). More generally, they can be expressed by ($AgX_1/AgX_2/AgX_3$), wherein $X_1$ and $X_3$ are the same or different. The gap discontinuous in halogen composition between the respective adjacent layers is as specified above.

The gap phase has the difference discontinuous in halogen composition. Specifically, the difference means that the halogen composition of a halogen salt solution (hereinafter referred to as "an $X^-$ salt solution") to be added or the halogen composition of fine silver halide grains to be added is changed at the gap phase as specified above, and does not mean the structure of the grain itself. It is particularly preferred that the gap in halogen composition is not the gap in $I^-$ content, but different in $Br^-$ content. It is further preferred that the grain has two gap phases in $Br^-$ content.

The diameter of circles equivalent to the projected areas of the silver halide grains first formed here is preferably 0.15 μm or less, more preferably 0.02 to 0.1 μm.

The thickness of the $AgX_2$ layer is preferably an amount covering a surface of the $AgX_1$ layer with one lattice layer on average, more preferably an amount covering the $AgX_1$ layer with from 3 lattice layers to a 10-fold molar amount of the $AgX_1$ layer, and further more preferably an amount covering the $AgX_1$ with from 10 lattice layers to a 3-fold molar amount of the $AgX_1$ layer. It is preferred that the gap structure is equal between the grains. This is because grains equal in (the number of screw dislocations/grain) are formed, and because tabular grains having a narrow grain size distribution are formed.

The shape of the main plane of the above-described tabular grains includes a right-angled parallelogram (wherein the ratio of the adjacent sides [(the length of one side/the length of the other) of one grain]is preferably 1 to 10, more preferably 1 to 5, and further more preferably 1 to 2); a shape wherein the four corners of a right-angled parallelogram are asymmetrically removed (for details, reference will be made to the description in Japanese Patent Application No. Hei. 4-145031 (1992)); and an approximated shape wherein at least two opposite sides of the four sides forming the main plane are outwardly convexly curved. Production of the tabular silver halide emulsion of the present invention The tabular silver halide emulsion of the present invention is produced through at least a process of forming nuclei and a process of ripening.

First, the process of forming nuclei is described.

(1) The Process of Forming Nuclei

An $AgNO_3$ solution and a halide salt (hereinafter referred to as an $X^-$ salt) solution are added into a dispersion medium solution containing at least a dispersion medium and water, with stirring, to form nuclei.

At the time of this formation of nuclei, defects that will cause anisotropic growth are formed. These defects are called screw dislocations in the present invention. To form screw dislocations, it is required that the atmosphere in which the nuclei will be formed is brought to an atmosphere wherein (100) planes will be formed, so that (100) crystal planes will appear on the nuclei. In the case of AgCl nuclei, (100) crystal planes will appear under normal conditions unless a special adsorbent and special conditions are used. Therefore, it is recommended that the formation of screw dislocations is carried out under normal conditions. Herein the terms "special adsorbent" and "special conditions" means conditions under which twin planes are formed or octahedral AgCl grains are formed, and reference can be made to the descriptions in U.S. Pat. Nos. 4,399,215, 4,414,306, 4,400,463, 4,713,323, 4,804,621, 4,783,398, 4,952,491, and 4,983,508; Journal of Imaging Science, Vol. 33, 13 (1989); Journal of Imaging Science, Vol. 34, 44 (1990); and Journal of Photographic Science, Vol. 36, 182 (1988).

On the other hand, in the case of AgBr nuclei, (100) planes are formed only under restricted conditions; that is, under the conventionally known conditions under which cubic or tetradecahedral AgBr grains are formed. It is recommended that the screw dislocations are formed under such conditions. In this case, preferably the tetradecahedron is such that the expression: [the area of the (111) plane/the area of the (100) plane]=$x_1$ is 1 to 0, more preferably 0.3 to 0, further more preferably 0.1 to 0. In the case of AgBrCl grains, it is regarded that the properties change in proportion to the $Br^-$ content. Therefore, as the $Br^-$ content increases, the conditions under which the formation of nuclei is carried out are restricted. The above-mentioned area ratio can be measured by using, for example, the measuring method [T. Tani, Journal of Imaging Science, Vol. 29, 165 (1985)] wherein plane selection adsorption dependability of planes (111) and planes (100) of a sensitizing dye is used.

Further, the formation of (100) planes can be promoted by allowing an agent for promoting the formation of (100) planes to be present at the time of the formation of nuclei. With respect to specific compound examples of the above promoting agent and the usage thereof, reference may be made to the description of European Patent 0,534,395A1. In brief, an adsorbent containing an N atom having a resonantly stabilized $\pi$ electron pair is allowed to be present, in an amount of $10^{-5}$ to 1 mol/liter, preferably $10^{-4}$ to $10^{-1}$ mol/liter, in a dispersion medium solution, and it is used at a pH greater than value (the value of the pKa−0.5) of the particular compound, preferably a pH greater than that value of the pKa, more preferably a pH of (pKa+0.5) or over.

The concentration of the dispersion medium of the dispersion medium solution at the time of the formation of nuclei is 0.1 to 10 wt %, preferably 0.2 to 5 wt %; the pH is 1 to 12, preferably 2 to 11, more preferably 5 to 10; and the $Br^-$ concentration is $10^{-2}$ mol/liter or less, more preferably $10^{-2.5}$ mol/liter or less. The temperature is preferably 90° C. or below, more preferably 15 to 80° C. The $Cl^-$ concentration is $10^{-1}$ mol/liter or less.

Nuclei are formed under an atmosphere wherein (100) planes of nuclei will be formed to introduce screw dislocations in the nuclei; and in the present invention, one or more, preferably 2 to 4, and more preferably 2, gap phases discontinuous in halogen composition are formed in the nucleus, to introduce screw dislocations in the nucleus. This forcibly introduces screw dislocations in the nucleus by using misfit of the lattice constant between adjacent layers produced at the gap phases, which is excellent in production reproducibility in comparison with the method described in European Patent 0,534,395A1. That is, that patent discloses a method wherein $I^-$, having an extremely large ion diameter, is mixed into the AgCl lattice, or a method wherein coagulation of nuclei is used, but in that method the production reproducibility is poor. Further, since the mixing of $I^-$ into AgCl lowers the processability of the developer, it is particularly unpreferable. In a uniform composition, such as AgClBr and AgBrI, since few screw dislocations are introduced, it has a defect that systems that can be chosen are restricted.

Specifically, when a silver salt solution and an $X^-$ solution are added by the double-jet addition method to form nuclei, the halogen composition of the $X^-$ salt solution is caused to change discontinuously during the formation of nuclei. For instance, the period of the formation of nuclei is divided into two, and the halogen composition of the $X^-$ salt solution that will be added during the first period of the formation of nuclei, and the halogen composition of the $X^-$ salt solution that will be added during the second period of the formation of nuclei, are changed discontinuously in accordance with the gap amount of the halogen composition described above. If the period of the formation of nuclei is divided into three, the halogen compositions of the first, second, and third $X^-$ salt solutions, which will be added successively, are changed in accordance with the gap amount of the halogen composition described above. Alternatively, the period of the formation of nuclei is divided into n periods (n is an integer of one or more), and the halogen compositions of the $X^-$ salt solutions that will be added successively in each adjacent period for adding are changed discontinuously in accordance with the gap amount of the halogen composition described above. (the number of produced screw dislocations/grain)=a is dependent, for example, on the difference between gaps discontinuous in halogen composition mentioned above, the thickness of each of the $AgX_1$ layer, the $AgX_2$ layer, and the $AgX_3$ layer; and the pH, the pAg, the temperature, the concentration of the dispersion medium, and the concentration of the adsorbent at the time of the formation of nuclei.

It is recommended that nuclei are formed under conditions in which the frequency of the formation of rod-like grain nuclei having one screw dislocation, twin grain nuclei, and nuclei having growth-promotion defects in three-dimensional directions, are less, and the frequency of the formation of the above-mentioned tabular grain nuclei is high. Depending on each case, it is recommended that nuclei are formed under the most preferable conditions that will be found in a trial and error manner based on the design of experiments. In order to prevent twin grains from being formed, it is preferable to additionally use the above-mentioned adsorbent that will be adsorbed selectively on (100) planes.

The silver salt solution and/or the $X^-$ salt solution that will be added at the time of the formation of nuclei to allow the formation of uniform nuclei can contain the dispersion medium. The concentration of the dispersion medium is preferably 0.1 wt % or more, more preferably 0.1 to 2 wt %, and further more preferably 0.2 to 1 wt %. A low-molecular-weight gelatin having a molecular weight of 3,000 to 50,000 is preferable.

Preferably the concentration of the dispersion medium is 0.1 wt %, more preferably 0.2 to 5 wt %, and further more preferably 0.3 to 2 wt %. The pH of said solution is 1 to 12, preferably 3 to 10, and more preferably 5 to 10.

(2) Ripening

At the time of the formation of nuclei, it is impossible to form only the tabular grain nuclei discriminately. Accordingly, in the subsequent ripening process, grains other than tabular grains are caused, by Ostwald ripening, to disappear. The ripening temperature is preferably made higher than the nucleus formation temperature by 10° C. or more, more preferably 20° C. or more. Generally 50° to 90° C., preferably 60° to 80° C., is used. If 90° C. or more is used, preferably the ripening is carried out at atmospheric pressure or higher, preferably under atmospheric pressure times 1.2 or more. With respect to details of this pressurized ripening method, reference can be made to the description of Japanese Patent Application No. 343180/1991. Preferably the ripening is carried out under an atmosphere for the formation of (100) planes, and specifically the ripening is carried out under an atmosphere for the formation of the above-specified cubes or tetradecahedrons.

When the $Br^-$ content of the nucleus is preferably 70 mol % or more, more preferably 90 mol % or more, the excess ion concentration of $Ag^+$and $Br^-$ of the solution at the time of ripening is preferably $10^{-2.3}$ mol/liter or less, more preferably $10^{-2.5}$ mol/liter or less. The pH of the solution is preferably 2 or more, more preferably 2 to 11, and further more preferably 2 to 7. When the ripening is carried out under these pH and pAg conditions, cubic fine grains free from defects mainly disappear and tabular grains grow preferentially in the directions of edges. As the conditions deviate from said excess ion concentration conditions, the preferential growability of the edges lowers and the disappearing rate of the nontabular grains becomes low. In addition, the rate of the growth of the main planes of the grains increases and the aspect ratio of the grains lowers. If an AgX solution is allowed to be present at the time of the ripening, the ripening is promoted. However, since said conditions change depending, for example, on the halogen composition of the AgX grains, the pH, the pAg, the gelatin concentration, the temperature, and the AgX solvent concentration, the optimum conditions can be selected in a trial and error fashion in accordance with the case.

When the $Cl^-$ content of nuclei is preferably 30 mol % or more, more preferably 60 mol % or more, further more preferably 80 mol % or more, the $Cl^-$ excess ion concentration of the solution at the time of ripening is such that the pCl value is preferably 3 or less, more preferably 1 to 2.5, and further more preferably 1 to 2. Preferably the pH is 2 to 11, more preferably 3 to 9.

Further, the ripening can be carried out while the silver salt solution and the $X^-$ salt solution are added under low-supersaturated conditions by the double-jet method. Under a low degree of supersaturation, growth-active sites having screw dislocations grow preferentially and fine grains having no said defects disappear. This is because the degree of supersaturation required for the formation of metastable nuclei for the growth at the growth-active sites is lower, but the degree of supersaturation required for the formation of said metastable nuclei on planes free from defects is higher. Herein the term "low supersaturation" refers preferably to 30% or less, more preferably to 20% or less, at the time of critical addition. Herein the term "at the time of critical addition" means the degree of supersaturation at the time when the silver salt solution and the $X^-$ salt solution are added at a certain addition rate or a higher addition rate, to cause new nuclei to be formed.

Although at the time of the completion of said ripening process the product can be used as the emulsion of the present invention, generally the following crystal growth process is provided, because the amount (mol/liter) of the produced AgX grains is small and the grain size cannot be selected at will.

(3) The Crystal Growth Process

The ripening process increases the ratio of the tabular grains and the crystal growth process causes the grains to grow to the desired size. The grains are grown under conditions in which the above-specified (100) planes are formed. In this case, 1) an ion-solution addition method, wherein a silver salt solution and an $X^-$ salt solution are added, to allow the growth; 2) a fine-grain addition method, wherein AgX fine grains are formed previously and said fine grains are added, to allow the growth, and 3) a method that is a combination of the above two, can be mentioned.

In order to cause the tabular grains to grow preferentially in the edge directions, it is recommended to grow the grains under low-supersaturation conditions. Herein the term "low-supersaturation conditions" refers preferably to 35% or less, and more preferably 2 to 20%, at the time of the critical addition.

Conventionally, the lower the degree of supersaturation is, generally the broader the grain size distribution is. The cause thereof is as follows. Since the frequency of impingement of solute ions against grain surfaces is low under a low degree of supersaturation, the frequency of formation of nuclei for the growth is low and the process of formation of nuclei for the growth determines the growth. Since the probability of the formation of nuclei for the growth is proportional to the area under uniform solution conditions, grains having large growth surface areas grow more quickly. Therefore, larger grains grow more quickly than smaller grains and the grain size distribution becomes broad. This growth behavior is observed in normal crystal grains having no twin planes and in tabular grains having parallel twin planes. That is, in the case of normal crystal grains, the linear growth rate is proportional to the surface area, and in the case of tabular grains having parallel twin planes, the linear growth rate is proportional to the perimeter of the edge (i.e., the length of the trough line).

On the other hand, in the grains of the present invention, since only the screw dislocation defect (d1) out of the edge plane of the grain acts as the growth start point, the frequency of formation of the growth nuclei is proportional to the number of d1. Therefore, if (the number of d1/grain) is made uniform, grains will grow uniformly even under a low degree of supersaturation, and as the average grain diameter increases, the value of the coefficient of variation becomes small. By making uniform the size of nuclei formed at the formation of nuclei and making uniform the properties of grains of gap phase discontinuous in halogen composition, said (the number of d1/grain) can be made uniform. To form nuclei having a uniform size, it is recommended that generation of new nuclei is made completed in a short period of time, and then the growth is effected with a high supersaturated growth without allowing said nuclei and new nuclei to be formed, thereby making the size uniform. If it is carried out at a low temperature, small nuclei having a uniform size can be formed. Herein the expression "low temperature" means 50° C. or below, preferably 5° to 40° C., further preferably 5° to 30° C. Further, the expression "in a short period of time" means preferably 3 minutes or less, more preferably 1 minute or less, further more preferably 1 to 20 seconds.

When the tabular grains are grown under said low-degree supersaturation conditions, the monomer of the solute ions adsorbed on the main planes is desorbed before 2→n-mer takes place, an adsorption/desorption equilibrium is constituted, and the monomer is taken into the edge part finally. That is, this can be understood when the chemical equilibrium of the solute ions among the main plane, the solution phase, and the edge plane is considered by the energy diagram; when the van't Hoff's reaction isobar [$dLnKp/dT=H°/RT^2$], obtained from the Gibbs-Helmholtz equation and the chemical equilibrium equation ($G°=-RTLnKp$), is applied, and when the temperature change data of the grown length of the main plane and the edge plane is plotted. Generally, the higher the temperature is made, the more promoted the desorption of solute ions adsorbed on the main planes is, so that the edge plane is grown more selectively. Letting Kp=(the grown length of the edge plane/the grown length of the main plane), H≈about 13 KCal/mol.

As the degree of supersaturation at the time of the growth of crystals becomes high, the frequency at which the growth nuclei are also formed on the defect-free plane increases. That is, the tabular grains will grow in the direction of the thickness, and the aspect ratio of the obtained tabular grains is made small. This indicates that the growth proceeds in a multinuclei growth fashion. If the degree of supersaturation is made still higher, the frequency of the formation of the growth nuclei increases, changing continuously to diffusion-controlled growth.

In the fine-grain-emulsion addition method, an AgX fine-grain emulsion having a diameter of 0.15 μm or less, preferably 0.1 μm or less, and more preferably 0.06 to 0.006 μm, is added and said tabular grains are grown by Ostwald ripening. Said fine-grain emulsion can be added continuously or intermittently. Said fine-grain emulsion can be prepared continuously by supplying an $AgNO_3$ solution and an $X^-$ salt solution in a mixer provided near the reaction vessel, and said fine-grain emulsion can be added immediately to the reaction mixture continuously, or said fine grain emulsion can previously be prepared batchwise in a separate vessel, and then can be added continuously or intermittently. Said fine-grain emulsion can be added in the form of a liquid or a dried powder. Preferably said fine grains are substantially free from multi-twin grains. Herein the term "multi-twin grains" refers to grains having 2 or more twin planes per grain. The term "substantially free from" means that the ratio of the number of the multi-twin grains is 5% or less, preferably 1% or less, and more preferably 0.1% or less. More preferably there are substantially free from single-twin grains. Further preferably there are substantially free from screw dislocations. Herein the term "substantially free from" means the above-defined meaning.

Although the halogen composition of the emulsion may be different or uniform from grain to grain, when an emulsion having a halogen composition uniform from grain to grain is used, the properties of the grains can be easily made homogeneous. With respect to tabular grains for use in the present invention, a halogen composition distribution other than the halogen composition gap for forming the center part of tabular can be given at the growth process of tabular grains.

As an example of these, grains having the so-called layered type structure, wherein the halogen composition of the core in the silver halide grains is different from that of the shell (consisting of a layer or layers) surrounding the core; or grains having a structure non-layered parts different in halogen composition are present in the grains or on the surface of the grains (if the non-layered parts different in halogen composition are present on the surface of the grains, the parts different in composition may be joined to the edges, corners, or planes of grains) may suitably be chosen to use. To secure a high sensitivity, it is advantageous to use these grains and also preferable in view of pressure-resistance properties. If the silver halide grains have the above structure, the boundary of parts different in halogen composition may be a clear boundary, an obscure boundary formed by a mixed crystal due to the difference of the composition, or a boundary wherein the structure is continuously changed positively.

In the high-silver-chloride emulsion for use in the present invention, preferably the silver bromide localized phase other than the halogen composition gap for forming the center nucleus is layered or non-layered in the silver halide grains and/or on the surface of the grains as described above. The halogen composition of the above localized phase preferably has a silver bromide content of at least 10 mol %, more preferably the content is more than 20 mol %. Further, these localized phases may be present in the grains or on the edges, corners, or planes of the grains and one preferable example is one wherein the localized phase is grown epitaxially on the corners of the grains.

In this time, for the purpose of obtaining an wide latitude, preferably the above described monodisperses are used with blending in a same layer or in a multilayered coating.

The localized phase of the silver halide grains of the present invention or its substrate preferably contains different metal ions or their complex ions. Preferable metal ions are selected from ions of metals belonging to Groups VIII and IIb of the Periodic Table, their complex ions, lead ions, and thallium ions. Mainly, in the localized phase, ions selected from iridium ions, rhodium ions, and iron ions, and their complex ions, can be used; and mainly, in the substrate, ions of metals selected from osmium, iridium, rhodium, platinum, ruthenium, palladium, cobalt, nickel, iron, etc., and their complex ions can be used in combination. The localized phase and the substrate may be different in their kind of the metal ions and the concentration of the metal ions. Several of these metals can be used. Particularly, it is preferable to allow an iron compound and an iridium compound to be present in the silver bromide localized phase.

These metal-ion-providing compounds are incorporated in the localized phase of the silver halide grains of the present invention and/or some other grain part (substrate) at the time of the formation of silver halide grains by means, for example, of adding them into an aqueous gelatin solution, an aqueous halide solution, an aqueous silver salt solution, or other aqueous solution serving as a dispersing medium, or by adding silver halide fine grains already containing the metal ions and dissolving the fine grains.

These metal ions may be incorporated in emulsion grains before, during, or immediately after the formation of the grains. The time when the metal ions are incorporated in emulsion grains will be selected depending on their position in the grains.

Generally the silver halide emulsion for use in the present invention is chemically and spectrally sensitized.

With respect to the chemical sensitization method, a chemical sensitization, which uses a chalcogen sensitizer (specifically, sulfur sensitization, which typically includes the addition of an unstable sulfur compound; selenium sensitization, which uses a selenium compound; or tellurium sensitization, which uses a tellurium compound), a noble metal sensitization represented typically a gold sensitization, and a reduction sensitization can be used alone or in combination. With respect to compounds used in chemical sensitization, those described in Japanese Patent Application (OPI) No. Sho. 62-215272 (1987), page 18 (the right lower column) to page 22 (the right upper column), are preferably used.

Preferably, in particular, a tabular high-silver-chloride emulsion sensitized by gold/sulfur sensitization, gold/selenium sensitization, or gold sensitization is used.

The emulsion for use in the present invention is a so-called surface latent image-type emulsion, wherein a latent image is mainly formed on the grain surface.

To the silver halide emulsion for use in the present invention, various compounds or their precursors can be added for the purpose of preventing fogging during the production process, storage, or the processing of the photographic material, or for the purpose of stabilizing the photographic performance. Specific examples of these compounds are described in the above-mentioned Japanese Patent Application (OPI) No. Sho. 62-215272 (1987), pages 39 to 72, which compounds are preferably used. Further, 5-arylamino-1,2,3,4-thiatriazole compounds (whose aryl residues have at least one electron-attracting group respectively) described in EP 0447647 can also be preferably used.

The spectral sensitization is carried out for the purpose of spectrally sensitizing each emulsion layer of the photosensitive material of the present invention to a desired wavelength region of light.

In the photographic material of the present invention, as spectral sensitizing dyes used for spectral sensitization for blue, green, and red regions, for example, those described by F. M. Harmer in Heterocyclic compounds-Cyanine dyes and related compounds (published by John Wiley & Sons [New York, London], 1964) can be mentioned. As specific examples of the compounds and the spectral sensitization, those described in the above-mentioned Japanese Patent Application (OPI) No. Sho. 62-215272 (1987), page 22 (the right upper column) to page 38, are preferably used. As the red-sensitive spectral sensitizing dyes for high-silver-chloride emulsion grains high in silver chloride content, spectral sensitizing dyes described in Japanese Patent Application (OPI) No. Hei. 3-123340 (1991) are very preferable in view, for example, of the stability, the strength of the adsorption, and the temperature dependence of the exposure.

In the case wherein the photographic material of the present invention is to be spectral sensitized effectively in the infrared region, sensitizing dyes described in Japanese Patent Application (OPI) No. Hei. 3-15049 (1991), page 12 (the left upper column) to page 21 (the left lower column); in Japanese Patent Application (OPI) No. Hei. 3-20730 (1991), page 4 (the left lower column) to page 15 (the left lower column); in EP-0,420,011, page 4, line 21, to page 6, line 54; in EP-0,420,012, page 4, line 12, to page 10, line 33; in EP-0,443,466; and in U.S. Pat. No. 4,975,362 are preferably used.

To incorporate these spectral sensitizing dyes into the silver halide emulsion, they may be directly dispersed into the emulsion, or after they are dissolved in a solvent or a combination of solvents, such as water, methanol, ethanol, propanol, methyl Cellosolve, and 2,2,3,3-tetrafluoropropanol, the solution may be added to the emulsion. Also the spectral sensitizing dye may be formed together with an acid or a base into an aqueous solution, as described in Japanese Patent Publication Nos. Sho. 44-23389 (1969), Sho. 44-27555 (1969), and Sho. 57-22089 (1982), or the spectral sensitizing dye may be formed together with a surface-active agent into an aqueous solution or a colloid dispersion, as described in U.S. Pat. Nos. 3,822,135 and 4,006,025, and the obtained aqueous solution or colloid dispersion may be added to the emulsion. Also after the spectral sensitizing dye may be dissolved in a solvent substantially immiscible with water, such as phenoxyethanol, the solution is dispersed in water or a hydrophilic colloid and is added to the emulsion. The spectral sensitizing dye may be directly dispersed in a hydrophilic colloid, as described in Japanese Patent Application (OPI) Nos. Sho. 53-102733 (1978) and Sho. 58-105141 (1983), and the dispersion is added to the emulsion. The time at which the dispersion or solution is added to the emulsion may be at any stage of the preparation of the emulsion, which time is hitherto known and considered useful. That is, the dispersion or the solution may be added before or during the formation of grains of the silver halide emulsion, or during the period from immediately after the formation of grains till the washing step, or before or during the chemical sensitization, or during the period from immediately after the chemical sensitization till the cooling and solidifying of the emulsion, or at the time the coating solution is prepared. Although generally the addition of the dispersion or the solution is carried out in a period after the completion of the chemical sensitization and before the application, the dispersion or the solution may be added together with a chemical sensitizer to carry out spectral sensitization and chemical sensitization at the same time, as described in U.S. Pat. Nos. 3,628,969 and 4,225,666; or the addition may be carried out before chemical sensitization, as described in Japanese Patent Application (OPI) No. Sho. 58-113928 (1983); or the dispersion or the solution may be added before the completion of the precipitation of the silver halide grains, to allow the spectral sensitization to start. Further, as taught in U.S. Pat. No. 4,225,666, it is possible that the spectrally sensitizing dye may be divided into two portions and added: one portion is added prior to chemical sensitization, and the other is added after the chemical sensitization. As shown in U.S. Pat. No. 4,183,756, the dispersion or the solution may be added at any time during the formation of silver halide grains. In particular, the sensitizing dye is preferably added before the washing step of the emulsion or before chemical sensitization of the emulsion.

The amount of these spectral sensitizing dyes to be added varies widely depending on the case and is preferably in the range of $0.5\times10^{-6}$ to $1.0\times10^{-2}$ mol, more preferably $1.0\times10^{-6}$ to $5.0\times10^{-3}$ mol, per mol of the silver halide.

In the present invention, if a sensitizing dye has spectral sensitization sensitivity particularly in from the red region to the infrared region, it is preferable to use additionally a compound described in Japanese Patent Application (OPI) No. Hei. 2-157749 (1990), page 13 (the right upper column) to page 22 (the right lower column). By using these compounds, the preservability of the photographic material, the stability of the processing, and the supersensitizing effect can be increased specifically. In particular, additional use of compounds of general formulae (IV), (V), and (VI) in that patent is particularly preferable. These compounds are used in an amount of $0.5\times10^{-5}$ mol to $5.0\times10^{-2}$ mol, preferably $5.0\times10^{-5}$ mol to $5.0\times10^{-3}$ mol, per mol of the silver halide and the advantageous amount is in the range of 0.1 to 10,000, preferably 0.5 to 5,000, times one mol of the sensitizing dye.

The photosensitive material of the present invention is used in a print system using common negative printers, and also it is preferably used for digital scanning exposure that uses monochromatic high-density light, such as a second harmonic generating light source (SHG) that comprises a combination of a nonlinear optical crystal with a semiconductor laser or a solid state laser using a semiconductor laser as an excitation light source, a gas laser, a light-emitting diode, or a semiconductor laser. To make the system compact and inexpensive, it is preferable to use a semiconductor laser or a second harmonic generating light source (SHG) that comprises a combination of a nonlinear optical crystal with a semiconductor laser or a solid state laser. Particularly, to design an apparatus that is compact, inexpensive, long in life, and high in stability, the use of a semiconductor laser is preferable, and it is desired to use a semiconductor laser for at least one of the exposure light sources.

If such a scanning exposure light source is used, the spectral sensitivity maximum of the photographic material of the present invention can arbitrarily be set by the wavelength of the light source for the scanning exposure to be used. In an SHG light source obtained by combining a nonlinear optical crystal with a semiconductor laser or a solid state laser that uses a semiconductor laser as an excitation light source, since the emitting wavelength of the laser can be halved, blue light and green light can be obtained. Therefore, the spectral sensitivity maximum of the photographic material can be present in each of the blue region, the green region, and the red region. In order to use a semiconductor laser as a light source to make the apparatus inexpensive, high in stability, and compact, preferably each of at least two layers has a spectral sensitivity maximum at 670 nm or over. This is because the emitting wavelength range of the available, inexpensive, and stable III–V group semiconductor laser is present now only in from the red region to the infrared region. However, on the laboratory level, the oscillation of a II–VI group semiconductor laser in the green or blue region is confirmed and it is highly expected that these semiconductor lasers can be used inexpensively and stably if production technique for the semiconductor lasers is developed. In that event, the necessity that each of at least two layers has a spectral sensitivity maximum at 670 nm or over becomes lower.

In such scanning exposure, the time for which the silver halide in the photographic material is exposed is the time for which a certain very small area is required to be exposed. As the very small area, the minimum unit that controls the quantity of light from each digital data is generally used and is called a picture element. Therefore, the exposure time per picture element is changed depending on the size of the picture element. The size of the picture element is dependent on the density of the picture element, and the actual range is from 50 to 2,000 dpi. If the exposure time is defined as the time for which a picture size is exposed with the density of the picture element being 400 dpi, preferably the exposure time is $10^{-4}$ sec or less, more preferably $10^{-6}$ sec or less. The exposure time is preferably $10^{-10}$ to $10^{-4}$ sec.

In the photographic material according to the present invention, for the purpose of preventing irradiation or halation or of improving, for example, safelight immunity, preferably a dye, which can be decolored by processing (in particular, an oxonol dye or a cyanine dye), as described in European Patent EP 0337490A2, pages 27 to 76, is added to the hydrophilic colloid layer.

Some of these water-soluble dyes deteriorate the color separation or the safelight immunity if the amount thereof to be used is increased. As a dye that can be used without deteriorating the color separation, a water-soluble dye described in EP-No. 0539978A1, Japanese Patent Application (OPI) Nos. Hei. 5-127325 (1993), and Hei. 5-127324 (1993) are preferable.

In the present invention, instead of or in combination with the water-soluble dye, a colored layer capable of being decolored by processing is used. The colored layer used that can be decolored by processing may be arranged in contact with the emulsion layer directly or through an intermediate layer containing a processing color-mix inhibitor, such as gelatin and hydroquinone. This colored layer is preferably located under the emulsion layer (on the side of the support) that will form a primary color which is the same as that of the colored layer. Colored layers corresponding to respective primary colors may all be arranged, or only some of them may be arbitrarily selected and arranged. A colored layer that has been colored to correspond to several primary color regions can also be arranged. The optical reflection density of the colored layer and the water-soluble dye are preferably such that the value of the optical density at the wavelength at which the optical density is highest in the wavelength region used for the exposure (in the visible light region of 400 nm to 700 nm in a usual printer exposure and in the wavelength of the scanning exposure light source to be used in the case of scanning exposure) is 0.2 or higher but 3.0 or lower, more preferably 0.5 or higher but 2.5 or lower, and particularly preferably 0.8 or higher but 2.0 or lower.

To form the colored layer, conventionally known methods can be applied. For instance, a method wherein a dye described in Japanese Patent Application (OPI) No. Hei. 2-282244 (1990), page 3 (the right upper column) to page 8, or a dye described in Japanese Patent Application (OPI) No. Hei. 3-7931 (1991), page 3 (the right upper column) to page 11 (the left lower column), is brought into the form of a solid fine particle dispersion and is allowed to be contained in a hydrophilic colloid layer; a method wherein an anionic dye is fixed to a cationic polymer; a method wherein a dye is adsorbed to fine particles, for example, of a silver halide and is fixed into a layer; or a method wherein colloidal silver is used as described in Japanese Patent Application (OPI) No. Hei. 1-239544 (1989); can be mentioned. As the method for dispersing a fine powder of a dye in the solid state, for example, a method is described in Japanese Patent Application (OPI) No. Hei. 2-308244 (1990), pages 4 to 13, wherein a fine powder dye, which is substantially insoluble in water at a pH of at least 6 or below, but which is substantially soluble in water at a pH of at least 8, is incorporated. Further, a method wherein an anionic dye is fixed to a cationic polymer is described in Japanese Patent Application (OPI) No. Hei. 2-84637 (1990), pages 18 to 26. Methods for preparing colloidal silver as a light-absorbing agent are described in U.S. Pat. Nos. 2,688,601 and 3,459,563. Among these methods, a method for incorporating a fine powder dye and a method for using colloidal silver are preferable.

In order to prevent various molds and bacteria which propagate in the hydrophilic colloid layers and deteriorate the image, preferably an antifungal agent described in, for example Japanese Patent Application No. Sho. 63-271247 (1988) is used.

As the silver halide emulsion to be applied to the photographic material of the present invention and the other materials (e.g., additives) and the photographic constitutional layers (including the arrangement of the layers) to be applied thereto and the processing method and additives used in the processing of the photographic material of the present invention, those described in the below-mentioned patent gazettes, particularly in European Patent EP 0,355,660A2 (Japanese Patent Application (OPI) No. Hei. 2-139544), are preferably used.

TABLE 1

| Element constituting photographic material | Japanese Patent Application (OPI) No. Sho. 62-215272 | Japanese Patent Application (OPI) No. Hei. 2-33144 | EP No. 0,355,660A2 |
|---|---|---|---|
| Silver halide emulsion | p.10 upper right column line 6 to p.12 lower left column line 5, and p.12 lower right column line 4 from the bottom to p.13 upper left column line 17 | p.28 upper right column line 16 to p.29 lower right column line 11 and p.30 lines 2 to 5 | p.45 line 53 to p.47 line 3 and p.47 lines 20 to 22 |
| Solvent for silver halide | p.12 lower left column line 6 to 14 and p.13 upper left column line 3 from the bottom to p.18 lower left column last line | — | — |
| Chemical sensitizing agent | p.12 lower left column line 3 from the bottom to lower right column line 5 from the bottom and p.18 lower right column line 1 to p.22 upper right column line 9 from the bottom | p.29 lower right column line 12 to last line | p.47 lines 4 to 9 |
| Spectral sensitizing agent (method) | p.22 upper right column line 8 from the bottom to p.33 last line | p.30 upper left column liens 1 to 13 | p.47 lines 10 to 15 |
| Emulsion stabilizer | p.39 upper left column line 1 to p.72 upper right column last line | p.30 upper left column line 14 to upper right column line 1 | p.47 lines 16 to 19 |
| Developing accelerator | p.72 lower left column line 1 to p.91 upper right column line 3 | — | — |

TABLE 2

| Element constituting photographic material | Japanese Patent Application (OPI) N . Sho. 62-215272 | Japanese Patent Application (OPI) No. Hei. 2-33144 | EP No. 0,355,660A2 |
|---|---|---|---|
| Color coupler (Cyan magenta, and Yellow couplers) | p.91 upper right column line 4 to p.121 upper left column line 6 | p.3 upper right column line 14 to p.18 upper left column last line and p.30 upper right column line 6 to p.35 lower right column line 11 | p.4 lines 15 to 27, p.5 line 30 to p.28 last line, p.45 lines 29 to 31 and p.47 line 23 to p.63 line 50 |
| Color formation-strengthen agent | p.121 lower left column line 7 to p.125 upper right column line 1 | — | — |
| Ultra violet absorbent | p.125 upper right column line 2 to p.127 lower left column last line | p.37 lower right column line 14 to p.38 upper left column line 11 | p.65 lines 22 to 31 |
| Discoloration inhibitor (Image-dye stabilizer) | p.127 lower right column line 1 to p.137 lower left column line 8 | p.36 upper right column line 12 to p.37 upper left column line 19 | p.4 line 30 to p.5 line 23, p.29 line 1 to p.45 line 25 p.45 lines 33 to 40 and p.65 lines 2 to 21 |
| High-boiling and/or low-boiling solvent | p.137 lower left column line 9 to p.144 upper right column last line | p.35 lower right column line 14 to p.36 upper left column line 4 from the bottom | p.64 lines 1 to 51 |
| Method for dispersing additives for photograph | p.144 lower left column line 1 to p.146 upper right column line 7 | p.27 lower right column line 10 to p.28 upper left column last line and p.35 lower right column line 12 to p.36 upper right column line 7 | p.63 line 51 to p.64 line 56 |

TABLE 3

| Element constituting photographic material | Japanese Patent Application (OPI) No . Sho. 62-215272 | Japanese Patent Application (OPI) No. Hei. 2-33144 | EP No. 0,355,660A2 |
|---|---|---|---|
| Film Hardener | p.146 upper right column line 8 to p.155 lower left column line 4 | — | — |
| Developing Agent precursor | p.155 lower left column line 5 to p.155 lower right column line 2 | — | — |
| Compound releasing development inhibitor | p.155 lower right column lines 3 to 9 | — | — |
| Support | p.155 lower right column line 19 to p.156 upper left column line 14 | p.38 upper right column line 18 to p.39 upper left column line 3 | p.66 line 29 to p.67 line 13 |
| Constitution of photo-sensitive layer | p.156 upper left column line 15 to p.156 lower right column line 14 | p.28 upper right column lines 1 to 15 | p.45 lines 41 to 52 |
| Dye | p.156 lower right column line 15 to p.184 lower right column last line | p.38 upper left column line 12 to upper right column line 7 | p.66 lines 18 to 22 |
| Color-mix inhibitor | p.185 upper left column line 1 to p.188 lower right column line 3 | p.36 upper right column lines 8 to 11 | p.64 line 57 to p.65 line 1 |
| Gradation controller | p.188 lower right column lines 4 to 8 | — | — |

TABLE 4

| Element constituting photographic material | Japanese Patent Application (OPI) No. Sho. 62-215272 | Japanese Patent Application (OPI) No. Hei. 2-33144 | EP No. 0,355,660A2 |
|---|---|---|---|
| Stain inhibitor | p.188 lower right column line 9 to p.193 lower right column line 10 | p.37 upper left column last line to lower right column line 13 | p.65 line 32 to p.66 line 17 |
| Surface-active agent | p.201 lower left column line 1 to p.210 upper right column last line | p.18 upper right column line 1 to p.24 lower right column last line and p.27 lower left column line 10 from the bottom to lower right column line 9 | — |
| Fluorine-containing agent (As Antistatic agent, coating aid, lubricant, adhesion inhibitor, or the like) | p.210 lower left column line 1 to p.222 lower left column line 5 | p.25 upper left column line 1 to p.27 lower right column line 9 | — |
| Binder Hydrophilic colloid) | p.222 lower left column line 6 to p.225 upper left column last line | p.38 upper right column lines 8 to 18 | p.66 lines 23 to 28 |
| Thickening agent | p.225 upper right column line 1 to p.227 upper right column line 2 | — | — |
| Antistatic agent | p.227 upper right column line 3 to p.230 upper left column line 1 | — | — |

TABLE 5

| Element constituting photographic material | Japanese Patent Application (OPI) No. Sho. 62-215272 | Japanese Patent Application (OPI) N . Hei. 2-33144 | EP No. 0,355,660A2 |
|---|---|---|---|
| Polymer latex | p.230 upper left column line 2 to p.239 last line | — | — |
| Matting agent | p.240 upper left column line 1 to p.240 upper right column last line | — | — |
| Photographic processing method (processing process, additive, etc.) | p.3 upper right column line 7 to p.10 upper right column line 5 | p.39 upper left column line 4 to p.42 upper left column last line | p.67 line 14 to p.69 line 28 |

Note: In the cited part of Japanese Patent Application (OPI) No. Sho. 62-215272, amendment filed on March 16, Showa 62 is included. Further, among the above-mentioned color couplers, it is preferred to use so-called short wavelength-type yellow coupler, described in Japanese Patent Application (OPI) Nos. Sho. 63-231451, Sho. 63-123047, Sho. 63-241547, Hei. 1-173499, Hei. 1-213648, and Hei. 1-250944, as a yellow coupler.

Preferably, the cyan, magenta, and yellow couplers are impregnated into loadable latex polymers (e.g., loadable latex polymers described in U.S. Pat. No. 4,203,716) in the presence or absence of a high-boiling organic solvent listed in the above table, or they are dissolved together with water-insoluble and organic solvent-soluble polymers and are emulsified and dispersed into hydrophilic colloid aqueous solution.

As water-insoluble and organic solvent-soluble polymers that can be preferably used, homopolymers or copolymers described in U.S. Pat. No. 4,857,449, the seventh column to the fifteenth column, and in International Publication No. WO 88/00723, pages 12 to 30, can be mentioned. More preferably, methacrylate series polymers or acrylamide series polymers, particularly acrylamide series polymers, are used in view of color image stability and the like.

In the photographic material according to the present invention, color image preservability improving compounds as described in European Patent EP 0277589A2 are preferably used together with couplers, particularly, together with pyrazoloazole couplers and pyrrolotriazole couplers.

That is, the use of a compound described in the above-mentioned patent specifications that combines with the aromatic amine developing agent remaining after the color development processing to form a chemically inactive and substantially colorless compound and/or a compound described in the above-mentioned patent specifications that combines with the oxidized product of the aromatic amine color developing agent remaining after the color development processing to form a chemically inactive and substantially colorless compound simultaneously or singly is preferable, because, for example, the occurrence of stain or other side effects due to the formation of color formed dyes by the reaction of the color developing agent or its oxidized product remaining in the film during the storage after the processing with couplers can be prevented.

Further, as the cyan couplers, in addition to diphenylimidazole cyan couplers described in Japanese Patent Application (OPI) No. Hei. 2-33144 (1990), 3-hydroxypyridine cyan couplers described in European Patent EP 0333185A2 (particularly, that formed by attaching a chlorine coupling-off group to the 4-equivalent coupler of Coupler (42) to make it to be 2-equivalent and Couplers (6) and (9) which are listed as specific examples are preferable), cyclic active methylene cyan couplers described in Japanese Patent Application (OPI) No. Sho. 64-32260 (1989) (particularly Coupler Examples 3, 8, and 34 that are listed as specific examples are preferable), pyrrolopyrazole cyan couplers described in European Patent EP 0456226A1, pyrroloimidazole cyan couplers described in European Patent EP 0484909, and pyrrolotriazole cyan couplers described in European Patents EP 0488248 and EP 0491197A1 are preferably used. Among them, pyrrolotriazole cyan couplers are particularly preferably used.

As the yellow couplers, in addition to the compounds listed in the above table, acylacetamide yellow couplers whose acyl group has a 3- to 5-membered cyclic structure described in European Patent EP 0447969A1, malondianilide yellow coupler having a cyclic structure described in European Patent EP 0482552A1, and acylacetamide yellow couplers having a dioxane structure described in U.S. Pat. No. 5,118,599 are preferably used. Among them, acylacetamide yellow couplers whose acyl group is a 1-alkylcyclopropane-1-carbonyl group and malondianilide yellow couplers wherein one of the anilide constitutes an indoline ring are preferably used. These couplers can be used alone or in combination.

As the magenta couplers used in the present invention, 5-pyrazolone magenta couplers and pyrazoloazole magenta couplers as described in the known literature shown in the above table are used, but in particular, in view, for example, of the hue, the stability of images, and the color forming properties, pyrazolotriazole couplers wherein a secondary or tertiary alkyl group is bonded directly to the 2-, 3-, or 6-position of the pyrazolotriazole ring as described in Japanese Patent Application (OPI) No. Sho. 61-65245 (1986), pyrazoloazole couplers containing a sulfonamido group in the molecule as described in Japanese Patent Application (OPI) No. Sho. 61-65246 (1986), pyrazoloazole couplers having an alkoxyphenylsulfonamido ballasting group as described in Japanese Patent Application (OPI) No. Sho. 61-147254 (1986), and pyrazoloazole couplers having an alkoxy group or an aryloxy group in the 6-position as described in European Patent Nos. 226,849A and 294,785A are preferably used.

In the present invention, preferably the degree of swelling of the photographic layer of the silver halide color photographic material is 0.8 to 3.0, because it improves the adhesion of the processed color photographic material. Herein the term "the degree of swelling" means the value obtained by dividing the thickness of the photographic layer, which layer is obtained after dipping the color photographic material in distilled water at 33° C. for 2 minutes, by the thickness of the dry photographic layer. More preferably the degree of swelling is 1.0 to 2.7.

Herein the term "photographic layer" refers to a layer comprising at least one photosensitive silver halide emulsion layer and a group of stacked hydrophilic layers, with the hydrophilic layers and the photosensitive silver halide emulsion layer being in a water-permeable relationship with each other. Back layers provided on the side of the support that is opposite to the side on which the photographic sensitive layers are provided are excluded. The photographic layer is generally made up of multiple layers related to the formation of a photographic image, and it includes, in addition to silver halide emulsion layers, for example, an intermediate layer, a filter layer, an antihalation layer, and a protective layer.

To adjust the above-mentioned degree of swelling, any technique can be used; for example, the degree of swelling can be adjusted by the amount and the type of the gelatin used in the photographic film, and the amount and the type of the hardener used in the photographic film, or the degree of swelling can be adjusted by changing the drying conditions or aging conditions after the application of the photographic layer. For the photographic layer, gelatin is preferably used, but other hydrophilic colloids can be used. For example, use can be made of gelatin derivatives, graft polymers of gelatin with other polymer, proteins, such as albumin and casein; cellulose derivatives, such as hydroxyethylcellulose, carboxymethylcellulose, and cellulose sulfate; saccharide derivatives such as sodium alginate, and starch derivatives; as well as many kinds of synthetic hydrophilic polymer materials, including monopolymers and copolymers, such as polyvinyl alcohols, polyvinyl alcohol partial acetals, poly-N-vinyl pyrrolidones, polyacrylic acids, polymethacrylic acids, polyacrylamides, polyvinyl imidazoles, and polyvinylpyrazoles.

As the gelatin, in addition to lime-processed gelatin, acid-processed gelatin can be used, and also gelatin hydrolyzate and gelatin enzymolyzate can be used. The calcium content of these gelatins is preferably 1,000 ppm or less, more preferably 500 ppm or less. As the gelatin derivative, use can be made of those obtained by reacting gelatin with various compounds, such as acid halides, acid anhydrides, isocyanates, bromoacetic acid, alkanesultones, vinylsulfonamides, maleimide compounds, polyalkyleneoxides, and epoxy compounds.

As the above gelatin graft polymer, use can be made of those obtained by grafting gelatin with a monopolymer (homopolymer) or a copolymer of a vinyl monomer, such as acrylic acid, methacrylic acid, and their derivatives, for example their esters and amides, acrylonitrile and styrene. Particularly preferable is a polymer that is compatible with gelatin to a certain degree, such as a graft polymer of gelatin with a polymer, for example, of acrylic acid, methacrylic acid, acrylamide, methacrylamide, or a hydroxyalkyl methacrylate. Examples thereof are described, for example, in U.S. Pat. Nos. 2,763,625, 2,831,767, and 2,956,884. Typical synthetic hydrophilic polymers are described, for example, in West German Patent Application (OLS) No. 2,312,708, U.S. Pat. Nos. 3,620,751 and 3,879,205, and Japanese Patent Publication No. Sho. 43-7561 (1968).

As the hardening agent, for example, chromium salts (e.g., chromium alum and chromium acetate), aldehydes (e.g., formaldehyde, glyoxal, and glutaraldehyde), N-methylol compounds (e.g., dimethylol urea and methyloldimethylhydantoin), dioxane derivatives (e.g., 2,3-dihydroxydioxane), active vinyl compounds (e.g., 1,3,5-triacryloyl-hexahydro-s-triazine, bis(vinylsulfonyl) methyl ether, and N,N'-methylenebis[β-(vinylsulfonyl) propioneamide)), active halogen compounds (e.g., 2,4-dichloro-6-hydroxy-s-triazine), mucohalogenic acids (e.g., mucochloric acid and mucophenoxychloric acid), isooxazoles, dialdehyde starches, and 2-chloro-6-hydroxytriazinylated gelatin can be used, singly or as a combination of two or more.

Particularly preferable hardening agents are aldehydes, active vinyl compounds, and active halogen compounds.

As the color photographic material for use in the present invention, color papers, color reversal papers, direct positive color photographic materials, color negative films, and color reversal films can be mentioned. Preferably, color photographic materials for print, such as color papers, can be mentioned.

The present invention makes it possible, by using a photographic material that uses specific silver halide emulsion grains, to process and form an image on a photographic material with a good desilvering characteristics, even if the replenishing rate of a processing solution having a bleaching capacity, particularly a bleach-fix solution, is considerably reduced.

Now, the present invention is specifically described on the basis of the following Examples, but the present invention is not restricted by them.

EXAMPLE 1

Silver halide emulsions were prepared as follows. Using these emulsions, the mean volume of the volume load (the weighted mean volume) was found. The mean aspect ratio and the presence rate were found from electronmicrographs.

(Preparation of Silver Chlorobromide Emulsion A)

An aqueous solution of gelatin (containing 1,200 cc of $H_2O$, 6 g of empty gelatin and 0.5 g of NaCl, pH 9.0) was placed in a reaction vessel, and the temperature was elevated to 65° C. An aqueous solution containing 0.1 g/cc of $AgNO_3$ and an aqueous solution containing 0.0345 g/cc of NaCl were concurrently added and mixed at 15 cc/minutes for 12 minutes with stirring. Then, a gelatin solution (containing 100 cc of $H_2O$, 19 g of empty gelatin, and 1.3 g of NaCl) was added, and 1N $HNO_3$ solution was added to adjust the resulting solution to pH 4.0. Subsequently, the temperature was raised to 70° C., and ripening was carried out for 16 minutes, followed by addition of 0.1 mol by silver halide amount of a fine grain emulsion given later. After ripening for 15 minutes, addition of 0.15 mol of the fine grain emulsion and ripening for 15 minutes were repeated twice. After ripening for 2 minutes, the temperature was lowered to 45° C., and an NaOH solution was added to adjust the resulting solution to pH 5.2. Then, the above-described sensitizing dyes A and B were each added in an amount of $2\times10^{-4}$ mol per mol of silver halide. After stirring for 15 minutes, it was added 0.01 mol of KBr solution (1 g/100 cc of KBr) and was stirred for 5 minutes.

A sedimenting agent was added, the temperature was lowered to 27° C., the pH was adjusted to 4.0, and the emulsion was washed with water by sedimentation washing according to conventional methods. An aqueous solution of gelatin was added, the temperature was raised to 40° C., and the emulsion was adjusted to pH 6.4 and pCl 2.8. Then, the temperature was elevated to 55° C., and a sulfur sensitizing agent, a selenium sensitizing agent, and a gold sensitizing agent were added, to conduct optimal chemical sensitization.

The observation of the emulsion thus prepared under an electron microscope (TEM) revealed that 80% of all silver halide grains are tabular grains having (100) planes as main planes, the grains having a mean grain size of 1.4 μm, a mean aspect ratio of 6.5 and a mean grain volume of 0.33 $\mu m^3$.

The fine grain emulsion was prepared in the following manner. An aqueous solution of gelatin (containing 1,200 cc of $H_2O$, 24 g of gelatin (M3) having an average molecular weight of 30,000 and 0.5 g of NaCl, pH 3.0) was placed in a reaction vessel, and the temperature was elevated to 23° C. With stirring, an $AgNO_3$ solution (containing 0.2 g/cc of $AgNO_3$, 0.01 g/cc of (M3) and 0.25 cc/100 cc of 1N $HNO_3$) and an NaCl solution (containing 0.07 g/cc of NaCl, 0.01 g/cc of (M3) and 0.25 cc/100 cc of 1N KOH) were concurrently added and mixed at 90 cc/minute for 3 minutes and 30 seconds. After stirring for 1 minute, the solution was adjusted to pH 4.0 and pCl 1.7.

(Preparation of Silver Chlorobromide Emulsion BG)

Grains were prepared in the same procedure for the preparation of the above Emulsion A, except that the addition rate and the addition time of the first $AgNO_3$ and NaCl solutions were changed to 30 cc/minute and 6 minutes, respectively and the sensitizing dyes added after the formation of grains were C and D.

Chemical sensitization was carried out by using a tellurium sensitizing agent and a sulfur sensitizing agent to perform optimal chemical sensitization.

The obtained grains were tabular grains having (100) planes as main planes, a mean aspect ratio of 6.5, and a mean grain volume of 0.13 $\mu m^3$.

(Preparation of Silver Chlorobromide Emulsion BR)

Silver Chlorobromide Emulsion BR was prepared in the same procedure for the preparation of the above Silver Chlorobromide Emulsion BG, except that the sensitizing dye of the above Silver Chlorobromide Emulsion BG was changed to E and the chemical sensitization was carried out using a gold sensitizing agent and a sulfur sensitizing agent to perform optimal chemical sensitization, thereby preparing Silver Chlorobromide Emulsion BR. The obtained grains were tabular grains having (100) planes as main planes, a mean aspect ratio of 6.5, and a mean grain volume of 0.13 $\mu m^3$.

(Preparation of Silver Chlorobromide Emulsion C1)

To 1,600 cc of a 3% aqueous solution of gelatin treated with lime, 17.6 g of sodium chloride was added, and an aqueous solution containing 0.094 mol of silver nitrate and an aqueous solution containing 0.12 mol of sodium chloride were added to the above-mentioned solution maintained at 50° C. with vigorous stirring. Subsequently, an aqueous solution containing 0.85 mol of silver nitrate and an aqueous solution containing 1.15 mol of sodium chloride were added and mixed at 58° C. with vigorous stirring. Then, the temperature was lowered to 40° C., and desilvering was carried out by sedimentation washing, followed by addition of 90.0 g of lime-treated gelatin. To the resulting emulsion, 0.005 mol (in terms of silver) of an emulsion of fine silver bromide grains having a grain size of 0.05 μm was added at 50° C., to form a silver bromide-rich region on the surface of a silver chloride host grain, and then a sulfur sensitizing agent and a gold sensitizing agent were added to achieve optimal chemical sensitization at 50° C. incidentally, during the formation of the silver bromide fine grains, potassium hexachloroiridate(IV) was allowed to be contained in the silver bromide fine grains in an amount of 0.8 mg per 0.005 mol of the silver bromide fine grains.

In this way, Silver Chlorobromide Emulsion C1 (comprising cubic silver halide grains having a mean grain size (the diameter of the circle corresponding to the projected area) of 0.51 μm, the mean volume of the volume load being 0.13 $\mu m^3$, the coefficient variation of the grain size distribution being 0.09, and 0.53 mol % of silver bromide being locally contained in part of the surface of the grains with the rest made of silver chloride) was prepared.

(Preparation of Silver Chlorobromide Emulsion Y1)

Silver Chlorobromide Emulsion Y1 was prepared in the same procedure for Silver Chlorobromide Emulsion C1, except that the aqueous silver nitrate solution and the aqueous sodium chloride solution were added and mixed at 70° C.

In this way, Silver Chlorobromide Emulsion Y1 (comprising cubic silver halide grains having a mean grain size (the diameter of the circle corresponding to the projected area) of 0.70 μm, the mean volume of the volume load being 0.34 $\mu m^3$, the coefficient of variation of the grain size distribution being 0.08, and 0.53 mol % of silver bromide being locally contained in part of the surface of the grains with the rest made of silver chloride) was prepared.

(Preparation of Emulsion DG)

An aqueous solution of gelatin (containing 1,200 cc of $H_2O$, 20 g of deionized alkali-treated gelatin (hereinafter referred to as EA-Gel) and 0.8 g of NaCl , pH 6.0) was placed in a reaction vessel. An Ag-1 solution and an X-1 solution were concurrently added and mixed at 50 cc/minute for 15 seconds at 48° C. with stirring.

Here, the Ag-1 solution contains 20 g of $AgNO_3$, 0.6 g of low molecular weight gelatin having an average molecular weight of 20,000 (hereinafter referred to as 2M-Gel) and 0.2 ml of $HNO_3$ (1N) per 100 ml of water and the X-1 solution contains 7 g of NaCl and 0.6 g of 2M-Gel per 100 ml of water.

Then, an Ag-2 solution (containing 4 g of $AgNO_3$, 0.6 g of 2M-Gel and 0.2 ml of $HNO_3$ (1N) per 100 ml of water) and an X-2 solution (containing 2.8 g of KBr and 0.6 g of 2M-Gel per 100 ml of water) were concurrently added and mixed at 70 ml/minute for 15 seconds. Then, the Ag-1 solution and the X-1 solution were concurrently added and mixed at 25 ml/minute for 2 minutes. An aqueous solution of NaCl (0.1 g/ml) was added in an amount of 15 ml, and the temperature was raised to 70° C. After ripening for 5 minutes, the Ag-1 solution and the X-1 solution were concurrently added and mixed at 10 ml/minute for 15 minutes. Then, for growth of tabular grains, an emulsion of fine AgCl grains 99.9% or more of which have a mean grain size of 0.07 μm and contain no twin and no screw dislocation was added in an amount of 0.2 mol, followed by ripening for 15 minutes. The temperature was lowered to 40° C., and the pH was adjusted to 2.0. After stirring for 20 minutes, the pH was adjusted to 5.2, and 10 ml of a KBr-1 solution (1 g/100 ml KBr) was added, followed by stirring for 5 minutes. Then, after addition of the sensitizing agent C and D, shown below, a sedimenting agent was added, and the emulsion was washed with water according to conventional methods. This emulsion was subjected to optimal gold and sulfur sensitization by addition of a sulfur sensitizing agent and a gold sensitizing agent. The observation of the emulsion thus obtained under an electron microscope revealed that 80% of all silver halide grains are right-angled parallelogrammic tabular grains having (100) planes as main planes and an aspect ratio of 3 or more, the grains having a mean grain size of 1.05 μm, a mean aspect ratio of 7.0 and a mean grain volume of 0.13 $\mu m^3$. Further, the coefficient of variation of the grain size distribution of said tabular grains was 0.25.

(Preparation of Emulsion DR)

Emulsion DR was prepared in the same procedure for Emulsion DG, except that the sensitizing dyes used for Emulsion DG were changed to Sensitizing Dye E, shown below.

(Preparation of Emulsion E)

Emulsion E was prepared in the same procedure for Emulsion DG, except that the temperature for the preparation before the elevation of temperature to 70° C. was changed from 48° C. to 60° C. and the sensitizing dyes were changed to Sensitizing Dyes A and B, shown below. The observation of Emulsion E under an electron microscope revealed that 80% of the projected areas of all silver halide grains are right-angled parallelogrammic tabular grains having (100) planes as main planes and an aspect ratio of 3 or more, the grains having a mean grain diameter of 1.35 μm, a mean aspect ratio of 6.5 and a mean grain volume of 0.32 $\mu m^3$. Further, the coefficient of variation of the grain size distribution of said tabular grains was 0.28.

(Preparation of Emulsion FG)

Emulsion FG was prepared in the same formulation and procedure for Emulsion DG, except that the X-2 solution was changed to an X-3 solution (containing 1.3 g of NaCl 0.3 g of KI, and 0.6 g of 2M-Gel in 100 ml of water).

The observation of the emulsion thus obtained under an electron microscope revealed that 65% of the projected areas of all silver halide grains are right-angled parallelogrammic tabular grains having (100) planes as main planes and an aspect ratio of 3 or more, the grains having a mean grain diameter of 1.10 μm, a mean aspect ratio of 8.0 and a mean grain volume of 0.13 $\mu m^3$. Further, the coefficient of variation of the grain size distribution of said tabular grains was 0.29.

(Preparation of Emulsion FR)

Emulsion FR was prepared in the same procedure for Emulsion FG, except that the sensitizing dyes used for Emulsion FG were changed to Sensitizing Dye E, shown below.

(Preparation of Emulsion H)

Emulsion H was prepared in the same procedure for Emulsion FG, except that the temperature for the preparation before the elevation of temperature to 70° C. was changed from 48° C. to 60° C. and the sensitizing dyes were changed to Sensitizing Dyes A and B, shown below. The observation of Emulsion H under an electron microscope revealed that 60% of the projected areas of all silver halide grains are right-angled parallelogrammic tabular grains having (100) planes as main planes and an aspect ratio of 3 or more, the grains having a mean grain diameter of 1.45 μm, a mean aspect ratio of 7.5 and a mean grain volume of 0.32 $\mu m^3$. Further, the coefficient of variation of the grain size distribution of said tabular grains was 0.30.

By comparing the projected areas (%), it can be understood that, in comparison with Emulsions DG, DR, and E, Emulsions FG, FR, and H wherein I is used at the time of formation of the center of the tabular grains are low in the ratio of tabular formation.

Then, a multilayer color printing paper (101) having layer compositions shown below was prepared by coating various photographic constituting layers on a paper support laminated on both sides thereof with polyethylene film, followed by subjecting to a corona discharge treatment on the surface thereof and provided a gelatin under coat layer containing sodium dodecylbenzene-sulfonate. Coating solutions were prepared as follows:

Preparation of the Fifth Layer Coating Solution

To 19.1 g of cyan coupler (ExC), 10.4 g of ultraviolet ray absorber (UV-2), 19.1 g of Color Image Stabilizer (Cpd-1), 0.58 g of Color Image Stabilizer (Cpd-8), 0.58 g of Color Image Stabilizer (Cpd-10), 0.58 g of Color Image Stabilizer (Cpd-11), and 0.58 g of Color Image Stabilizer (Cpd-6) were added 30.8 ml of ethyl acetate, 12.7 g of solvent (Solv-6), and 0.58 g of solvent (Solv-1) and dissolved them, and the resulting solution was added in 230 ml of 20% aqueous gelatin solution containing 37 ml of 10% sodium dodecylbenzenesulfonate solution, and then emulsified and dispersed by an ultrasonic homogenizer. Thus the emulsified dispersion C was prepared.

Emulsion C1R prepared by subjecting the above-described silver chlorobromide emulsion C1 to optimum gold and sulfur sensitization using sodium thiosulfate and chloroauric acid, after adding the sensitizing dye E shown below, and the emulsified dispersion C were mixed and dissolved so as to give the composition shown below, thereby preparing the fifth layer coating solution Coating solutions for the first to fourth, sixth and seventh layers were prepared in the similar manner to the coating solution of fifth layer. As a gelatin hardener for the respective layers, 1-oxy-3,5-dichloro-s-triazine sodium salt was used.

Further, Cpd-14 and Cpd-15 were added in each layer in such amounts that the respective total amount becomes 25.0 $mg/m^2$ and 50.0 $mg/m^2$.

In silver chlorobromide emulsions of respective light-sensitive emulsion layers, the following spectral sensitizing dyes were used, respectively.

Blue-sensitive emulsion layer:

Sensitizing dye A

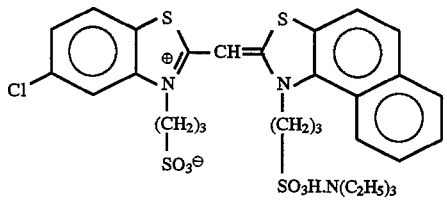

and

Sensitizing dye B

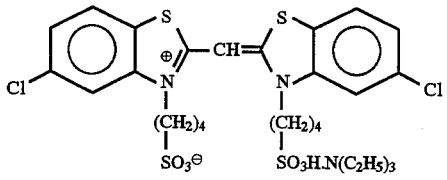

-continued (each $2.0 \times 10^{-4}$ mol per mol of silver halide.)

Green-sensitive emulsion layer:

Sensitizing dye C

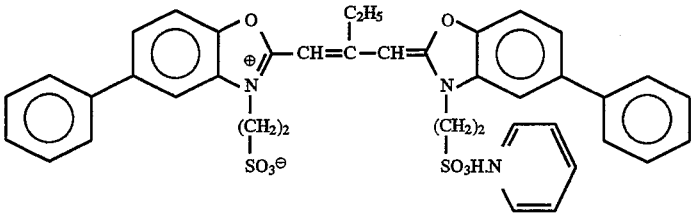

($4.0 \times 10^{-4}$ mol per mol of silver halide)

and

Sensitizing dye D

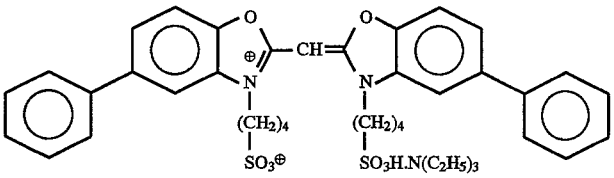

($7.0 \times 10^{-5}$ mol per mol of silver halide)

Red-sensitive emulsion layer:

Sensitizing dye E

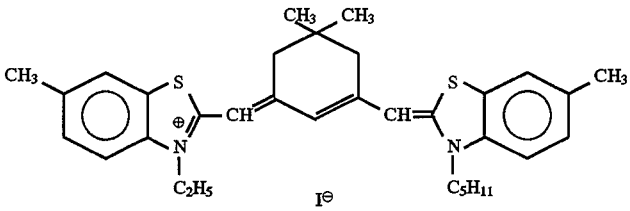

($0.9 \times 10^{-4}$ mol per mol of silver halide, and the following compound was further added in an amount of $2.6 \times 10^{-3}$ mol per mol of silver halide)

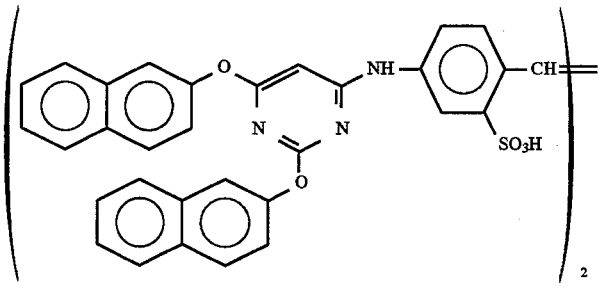

Further, 1-(5-methylureidophenyl)-5-mercaptotetrazole was added to the blue-sensitive emulsion layer, the green-sensitive emulsion layer, and the red-sensitive emulsion layer in amount of $8.5\times10^{-4}$ mol, $7.7\times10^{-4}$ mol, and $2.5\times10^{-4}$ mol, per mol of silver halide, respectively.

Further, 4-hydroxy-6-methyl-1,3,3a,7-tetrazaindene was added to the blue-sensitive emulsion layer and the green-sensitive emulsion layer in amount of $1\times10^{-4}$ mol and $2\times10^{-4}$ mol, per mol of silver halide, respectively.

The dyes shown below (the numeral values in parentheses represents coating amount) were added to the emulsion layers for prevention of irradiation.

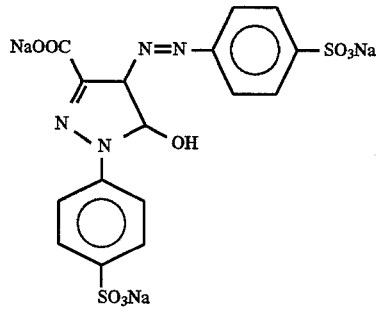

(10mg/m²)

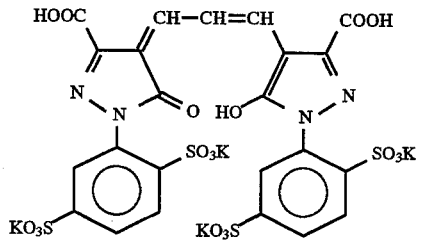

(5mg/m²)

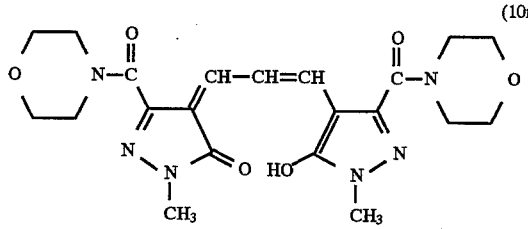

(10mg/m²)

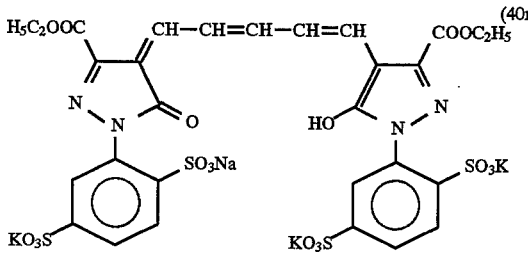

(40mg/m²)

and

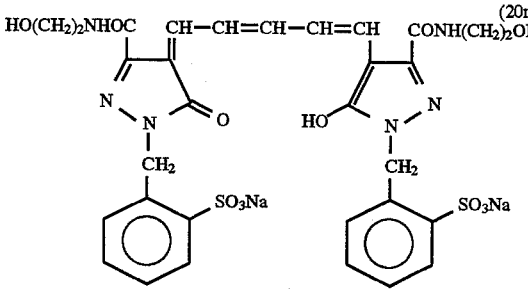

(20mg/m²)

(Composition of Layers)

The composition of each layer is shown below. The figures represent coating amount (g/m²). For the silver halide emulsion, the numerals indicates coating amount given in terms of silver.

| | |
|---|---|
| Support | |
| Paper laminated with polyethylene [polyethylene on the side of the first layer contains a white pigment ($TiO_2$, contained 14 wt %) and a bluish dye (ultramarine)] | |
| First Layer (Blue-sensitive Emulsion Layer) | |
| Silver Chlorobromide Emulsion Y1' (Emulsion prepared by subjecting the above-described emulsion Y1 to optimal gold, selenium, and sulfur sensitization using gold sensitizing agent, selenium sensitizing agent, and sulfur sensitizing agent, after adding sensitizing dyes A and B) | 0.27 |
| Gelatin | 1.36 |
| Yellow Coupler (ExY) | 0.79 |
| Color Image Stabilizer (Cpd-1) | 0.08 |
| Color Image Stabilizer (Cpd-2) | 0.04 |
| Color Image Stabilizer (Cpd-3) | 0.08 |
| Solvent (Solv-1) | 0.13 |
| Solvent (Solv-2) | 0.13 |
| Second Layer (Color Mixing Preventing Layer) | |
| Gelatin | 1.00 |
| Color Mixing Inhibitor (Cpd-4) | 0.06 |
| Solvent (Solv-2) | 0.25 |
| Solvent (Solv-3) | 0.25 |
| Solvent (Solv-7) | 0.03 |
| Third Layer (Green-sensitive Emulsion Layer) | |
| Silver Chlorobromide Emulsion C1G (Emulsion prepared by subjecting the above-described emulsion C1 to optimum tellurium and sulfur sensitization using tellurium compound and sulfur compound, after adding sensitizing dyes C and D) | 0.13 |
| Gelatin | 1.45 |
| Magenta Coupler (ExM) | 0.16 |
| Color Image Stabilizer (Cpd-2) | 0.03 |
| Color Image Stabilizer (Cpd-5) | 0.15 |
| Color Image Stabilizer (Cpd-6) | 0.01 |
| Color Image Stabilizer (Cpd-7) | 0.01 |
| Color Image Stabilizer (Cpd-8) | 0.08 |
| Solvent (Solv-3) | 0.50 |
| Solvent (Solv-4) | 0.15 |
| Solvent (Solv-5) | 0.15 |
| Fourth Layer (Color Mixing Preventing Layer) | |
| Gelatin | 0.70 |
| Color Mixing Inhibitor (Cpd-4) | 0.04 |
| Solvent (Solv-2) | 0.18 |
| Solvent (Solv-3) | 0.18 |
| Solvent (Solv-7) | 0.02 |
| Fifth Layer (Red-sensitive Emulsion Layer) | |
| Silver Chlorobromide Emulsion C1R | 0.20 |
| Gelatin | 0.85 |
| Cyan Coupler (ExC) | 0.33 |
| Ultraviolet Ray Absorber (UV-2) | 0.18 |
| Color Image Stabilizer (Cpd-1) | 0.33 |
| Color Image Stabilizer (Cpd-6) | 0.01 |
| Color Image Stabilizer (Cpd-8) | 0.01 |
| Color Image Stabilizer (Cpd-9) | 0.01 |

Compounds used are shown below:

(ExY) Yellow Coupler
A 1:1 mixture (molar ratio) of
(a) R = 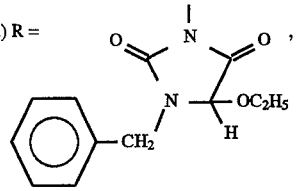
, X = Cl;
(b) R = 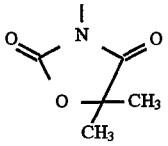
, X = $OCH_3$
of the following formula
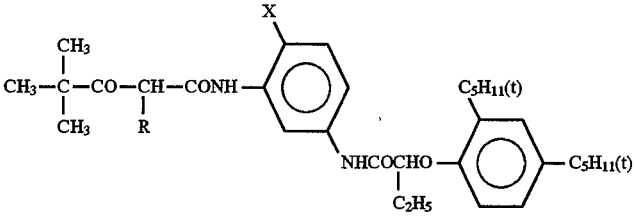
(Exm) Magenta Coupler
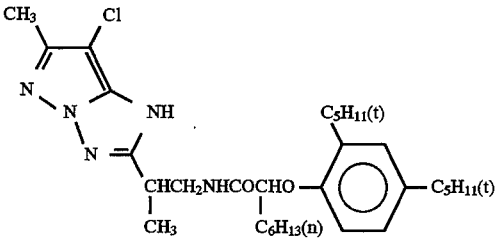
(ExC) Cyan Coupler
A 3:7 mixture (molar ratio) of
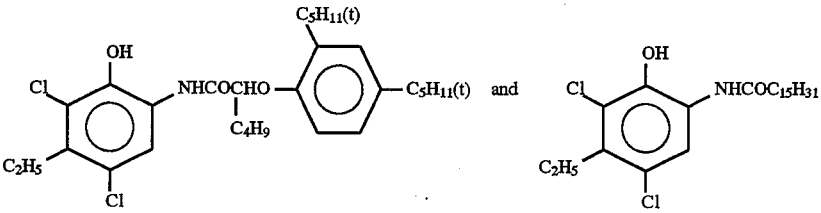
(Cpd-1) Color Image Stabilizer
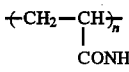
Av. molecular weight : 60,000

-continued
(Cpd-2) Color Image Stabilizer
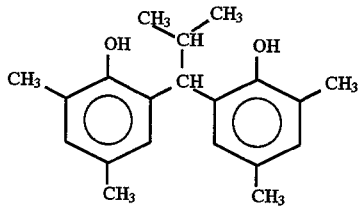
(Cpd-3) Color Image Stabilizer
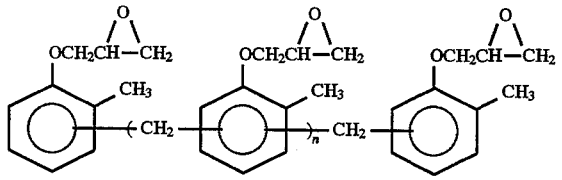
n = 7–8 (in average)
(Cpd-4) Color-mix Inhibitor
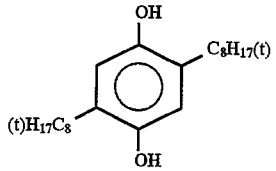
(Cpd-5) Color Image Stabilizer
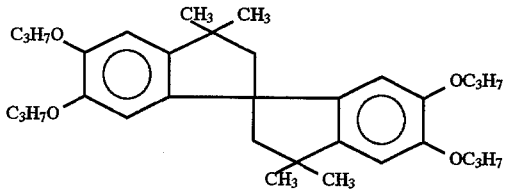
(Cpd-6) Color Image Stabilizer
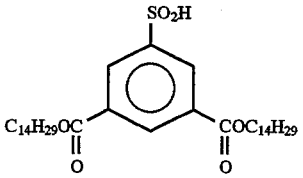
(Cpd-7) Color Image Stabilizer
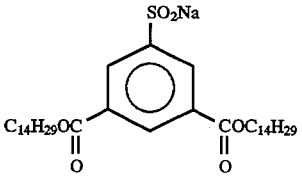
(Cpd-8) Color Image Stabilizer -continued
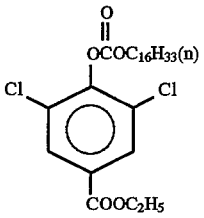
(Cpd-9) Color Image Stablizer
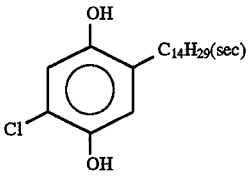
(Cpd-10) Color Image Stabilizer
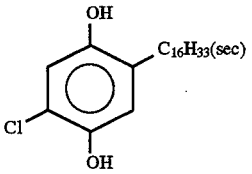
(Cpd-11) Color Image Stabilizer
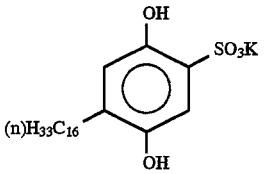
(Cpd-12) Color Image Stabilizer
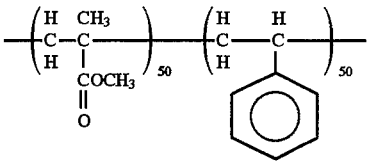
Av. molecular weight: 60,000
(Cpd-13) Color Image Stabilizer
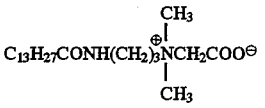
(Cpd-14) Antiseptic
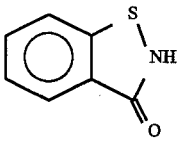
(Cpd-15) Antiseptic
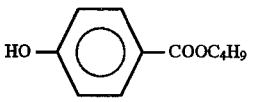
(UV-1) Ultraviolet Ray Absorber
A 1:5:10:5 mixture (weight ratio) of (i), (ii), (iii), and (iv)

-continued
(i)
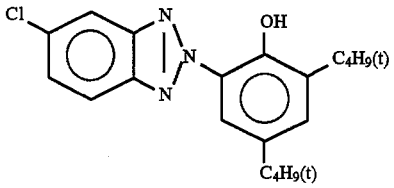
(iv)
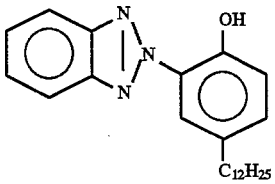
(iii)
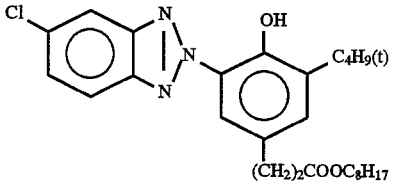
(iv)
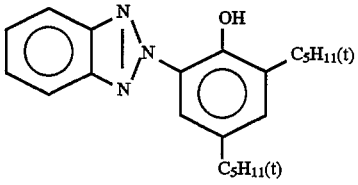
(UV-2) Ultraviolet Ray Absorber
A 1:2:2 mixture (weight ratio) of (v), (vi), and (vii)
(v)
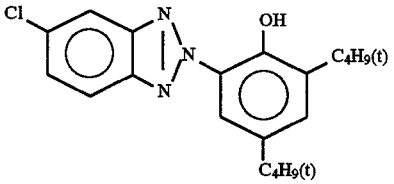
(vi)
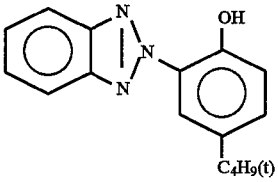
(vii)
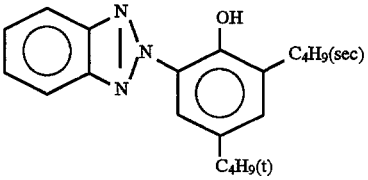
(Solv-1) Solvent
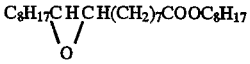
(Solv-2) Solvent
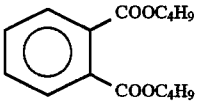
(Solv-3) Solvent
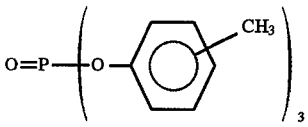
(Solv-4) Solvent
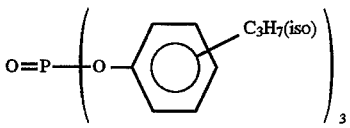
(Solv-5) Solvent
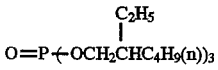
(Solv-6) Solvent
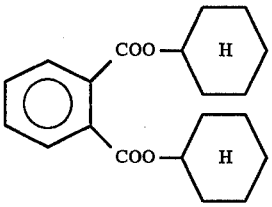

-continued (Solv-7) Solvent

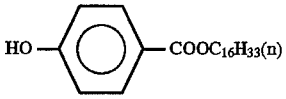

Coated Samples 101, 102, 103, and 104 were prepared similar to the photographic material having the above layer compositions, except that silver halide emulsions contained in respective layers were changed as shown in Table 9.

TABLE 9

| Sample | Red-sensitive emulsion | Green-sensitive emulsion | Blue-sensitive emulsion |
|---|---|---|---|
| 101 | C1R | C1G | Y1' |
| 102 | BR | BG | A |
| 103 | DR | DG | E |
| 104 | FR | FG | H |

With respect to the above photographic materials 101, 102, 103, and 104, after an imagewise exposure to light, continuous processing (running test) according to the processing stages shown below was conducted using a paper processor. The amount to be processed was 100 $m^2$ of photographic material per week, and the running test was carried out for 4 weeks. The test was carried out by changing the replenisher rate of bleach-fix solution using replenishers A to E (see Table 10) so that the concentration of iron complex, the concentration of thiosulfate, and pH at the equilibrium state of running were the same in each test.

| Processing stage | Temperature | Time | Replenisher* | Tank Capacity |
|---|---|---|---|---|
| Color developing | 38.5° C. | 45 sec | 73 ml | 5 liter |
| Bleach-fixing | 35.0° C. | 45 sec | See Table 11 | 5 liter |
| Rinse (1) | 35.0° C. | 20 sec | — | 3 liter |
| Rinse (2) | 35.0° C. | 20 sec | — | 3 liter |
| Rinse (3) | 35.0° C. | 20 sec | — | 3 liter |
| Rinse (4) | 35.0° C. | 30 sec | 242 ml | 3 liter |

Note: *Replenisher amount per $m^2$ of photographic material.
Rinsing steps were carried out in 4-tanks countercurrent mode from the tank of rinse (4) toward the tank of rinse (1).

| | [Tank Solution] | [Replenisher] |
|---|---|---|
| [Color-developer] | | |
| Water | 800 ml | 800 ml |
| Ethylenediaminetetraacetic acid | 3.0 g | 3.0 g |
| Disodium 4,5-dihydroxybenzene-1,3-disulfonate | 0.5 g | 0.5 g |
| Triethanolamine | 12.0 g | 12.0 g |
| Potassium chloride | 6.5 g | — |
| Potassium bromide | 0.03 g | — |
| Potassium carbonate | 27.0 g | 27.0 g |
| Fluorescent whitening agent (WHITEX 4, made by Sumitomo Chemical Ind.) | 1.0 g | 3.0 g |
| Sodium sulfite | 0.1 g | 0.1 g |
| Disodium-N,N-bis(sulfonatoethyl)-hydroxylamine | 5.0 g | 10.0 |
| Sodium polyisopropylnaphthalene(β)-sulfonate | 0.1 g | 0.1 g |
| N-ethyl-N-(β-methanesulfonamidoethyl)-3-methyl-4-aminoaniline.3/2 sulfate.$H_2O$ | 5.0 g | 11.5 g |
| Water to make | 1000 ml | 1000 ml |
| pH (25° C., by potassium hydroxide and sulfuric acid) | 10.00 | 11.00 |
| [Rinse solution] | | |
| (Tank solution and replenisher being the same) | | |
| Sodium chlorinated isocyanurate | 0.02 g | |
| Ion-exchanged water (permitivity: 5 μs/cm or below) | 1,000 ml | |
| pH | 6.5 | |

To each of the above coated samples, gradation wedge exposure was given using a sensitometer (FWM type, manufactured by Fuji Photo Film Co., Ltd., color temperature of light source: 3,200° K.). At that time, the exposure was carried out in such a manner that the exposure amount was 250 CMS with the exposure time being 0.1 sec.

After the above running test was complete, the above samples were processed using the above automatic processor, and desilvering characteristics of each sample was evaluated by the following method.

TABLE 10

| Composition | Tank Solution | Replenisher A | Replenisher B | Replenisher C | Replenisher D | Replenisher E |
|---|---|---|---|---|---|---|
| Water | 600 ml | 600 ml | 600 ml | 600 ml | 500 ml | 400 ml |
| Ammonium thiosulfate (75%) | 100 ml | 100 ml | 103 ml | 106 ml | 132 ml | 176 ml |
| Ammonium sulfite | 40.0 g | 40.0 g | 41.0 g | 42.0 g | 53.0 g | 70.0 g |
| Ethylenediaminetetraacetic acid | 3.0 g | 3.0 g | 3.1 g | 3.2 g | 3.8 g | 5.0 g |
| Fe(III) ammonium ethylenediaminetetraacetate (50%) | 108.6 g | 108.6 g | 111.5 g | 115.2 g | 143.4 g | 191.2 g |
| Nitric acid (67%) | 30.0 g | 30.0 g | 31.0 g | 32.0 g | 40.0 g | 53.0 g |
| Water to make | 1,000 ml | 1,000 ml | 1,000 ml | 1,000 ml | 1,000 ml | 1,000 ml |
| pH (25° C.) | 6.5 | 6.2 | 6.1 | 5.9 | 5.7 | 5.2 |

Note; pH was adjusted by nitric acid/ammonia.

The composition of each processing solution is as followed, respectively:

Desilvering Characteristics: the remaining amount of silver at a maximum density of each sample was determined by a fluorescent X-ray analysis.

Results obtained are shown in Table 11.

TABLE 11

| Experiment No. | Photographic Material No. | Replenishing Rate (ml/m$^2$) | Replenisher | Amount of Residual Silver (μg/cm$^2$) | Remarks |
|---|---|---|---|---|---|
| 1 | 101 | 218 | A | 4.2 | Comparative Example |
| 2 | 101 | 180 | B | 4.5 | Comparative Example |
| 3 | 101 | 150 | C | 7.2 | Comparative Example |
| 4 | 101 | 60 | D | 7.8 | Comparative Example |
| 5 | 101 | 30 | E | 8.1 | Comparative Example |
| 6 | 102 | 218 | A | 4.0 | Comparative Example |
| 7 | 102 | 180 | B | 4.1 | Comparative Example |
| 8 | 102 | 150 | C | 4.9 | This Invention |
| 9 | 102 | 60 | D | 5.3 | This Invention |
| 10 | 102 | 30 | E | 5.8 | This Invention |
| 11 | 103 | 218 | A | 3.9 | Comparative Example |
| 12 | 103 | 180 | B | 4.0 | Comparative Example |
| 13 | 103 | 150 | C | 4.5 | This Invention |
| 14 | 103 | 60 | D | 5.0 | This Invention |
| 15 | 103 | 30 | E | 5.2 | This Invention |
| 16 | 104 | 218 | A | 4.1 | Comparative Example |
| 17 | 104 | 180 | B | 4.3 | Comparative Example |
| 18 | 104 | 150 | C | 5.2 | This Invention |
| 19 | 104 | 60 | D | 5.7 | This Invention |
| 20 | 104 | 30 | E | 6.2 | This Invention |

As is apparent from the results shown in Table 11, even when the replenishment rate of bleach-fix solution was so remarkably reduced to as low as 150 to 30 ml per m$^2$, Photographic Materials 102 to 104 each show superior desilvering characteristics to Photographic Material 101 for comparison. Further, it can be noticed that the desilvering characteristics, at the above described replenishment rate, of the case using Tabular Emulsions DG, DR, and E having composition gap between Cl and Br was further improved than the case using Tabular Emulsions FG, FR, and H having composition gap between Cl and I (comparison of Photographic Material 103 with Photographic Material 104).

EXAMPLE 2

With respect to Photographic Materials 101, 102, 103, and 104 prepared in Examples 1 and 2, the same evaluation as that in Example 1 was repeated, except that the following exposure to light was carried out. The obtained results were the same as those of Examples 1. With respect to Photographic Materials 102, 103, and 104, an excellent desilvering characteristics was obtained by each subjecting to the photographic processing defined according to the present invention.

(Exposure to Light)

473 nm taken out by changing the wavelength of a YAG solid state laser (the emitting wavelength: 946 nm) using as a light source an excited semiconductor laser GaAlAs (the emitting wavelength: 808.5 nm) by an SHG crystal of $KNbO_3$, 532 nm taken out by changing the wavelength of a $YVO_4$ solid state laser (the emitting wavelength: 1064 nm) using as a light source an excited semiconductor laser GaAlAs (the emitting wavelength: 808.7 nm) by an SHG crystal of KPT, and AlGaInP (the emitting wavelength: about 670 nm; Type No. TOLD9211 manufactured by Toshiba) were used. The apparatus can carry out the exposure in such a manner that laser beams can scan successively a color photographic printing paper moving normally to the direction of the scanning by respective rotating polyhedrons. Using this apparatus to change the quantity of light, the relationship D—log E between the density of the photographic material (D) and the quantity of light (E) was determined. At that time, the quantities of the lights of laser beams having three wavelengths were modulated by using an external modulator to control the exposure amount. The scanning exposure was carried out at 400 dpi and the average exposure time per picture element was about $5\times10^{-8}$ sec. The temperature of the semiconductor laser was kept by using a Peltier device to prevent the quantity of light from being changed by temperature.

Having described our invention as related to the present embodiments, it is our intention that the invention not be limited by any of the details of the description, unless otherwise specified, but rather be construed broadly within its spirit and scope as set out in the accompanying claims.

What we claim is:

1. A method for forming an image by processing an image wise exposed silver halide color photographic material having at least one silver halide emulsion layer on a support, wherein at least one layer of the silver halide emulsion layers comprises tabular silver halide grains whose silver chloride content is 95 mol % or more; and said color photographic material is processed with:

(i) a color developer in a color development step, and (ii) a bleaching solution containing a bleaching agent and a fixing solution, or a bleach-fixing solution, in a desilvering step, where replenishment of a replenisher having a bleaching capacity in the desilvering step is at a rate of 150 ml or less per m$^2$ of the photographic material, and further wherein tabular grains having (100) planes as main planes and an aspect ratio of 1.5 or more occupy 35% or more of the total of projected areas of the whole silver halide emulsion grains in the silver halide emulsion layer, and the nuclei of said tabular grains have at least one gap phase discontinuous in halogen composition, said gap being a difference of 10 to 100 mol % in $Cl^-$ content or $Br^-$ content and/or a difference of 5 to 100 mol % in $I^-$ content, said tabular grains being produced by (1) forming nuclei having (100) planes having at least one phase discontinuous in halogen composition, said nuclei having been formed by covering a surface of an $AgX_1$ layer with at least an $AgX_2$ layer wherein $X_1$ and $X_2$ each represents a halide, and wherein $X_1$ is different from $X_2$ in $Cl^-$ content or $Br^-$ content by 10 to 100 mol %, and/or in $I^-$ content by 5 to 100 mol %, and wherein defects are formed in the nuclei by the at least one gap phase during formation of the nuclei, (2) ripening said nuclei, and (3) growing said nuclei into crystals of tabular shapes to give silver halide tabular grains.

2. A method for forming an image by processing an image wise exposed silver halide color photographic material having at least one silver halide emulsion layer on a support, wherein at least one layer of the silver halide emulsion layers comprises tabular silver halide grains whose silver chloride content is 95 mol % or more; and said color photographic material is processed with:

(i) a color developer in a color development step, and (ii) a bleaching solution containing a bleaching agent and a fixing solution, or a bleach-fixing solution, in a desilvering step, where replenishment of a replenisher having a bleaching capacity in the desilvering step is at a rate of 150 ml or less per $m^2$ of the photographic material, and further wherein tabular grains having (100) planes as main planes and an aspect ratio of 1.5 or more occupy 35% or more of the total of projected areas of the whole silver halide emulsion grains in the silver halide emulsion layer, and the nuclei of said tabular grains have at least one gap phase discontinuous in halogen composition, said gap being a difference of 10 to 100 mol % in $Cl^-$ content or $Br^-$ content, said tabular grains being produced by (1) forming nuclei having (100) planes having at least one phase discontinuous in halogen composition, said nuclei having been formed by covering a surface of an $AgX_1$ layer with at least an $AgX_2$ layer wherein $X_1$ and $X_2$ each represents a halide, and wherein $X_1$ is different from $X_2$ in $Cl^-$ content or $Br^-$ content by 10 to 100 mol %, wherein defects are formed in the nuclei by the at least one gap phase during formation of the nuclei, (2) ripening said nuclei, and (3) growing said nuclei into crystals of tabular shapes to give silver halide tabular grains.

3. The method for forming an image as claimed in claim 2, wherein the nuclei of said tabular silver halide grains have at least one gap phase discontinuous in halogen composition, the gap being a difference of 30 to 100 mol % in $Cl^-$ content or $Br^-$ content.

4. The method for forming an image as claimed in claim 2, wherein the silver halide color photographic material is exposed to light in such a scanning exposure manner that the exposure time per picture element is shorter than $10^{-4}$ second.

5. The method for forming an image as claimed in claim 4, wherein the exposure time per picture element of the silver halide color photographic material is $10^{-10}$ to $10^{-4}$ second.

6. The method for forming an image as claimed in claim 2, wherein the replenishment rate of replenisher having a bleaching capacity is 20 to 150 ml, per $m^2$ of the photographic material.

7. The method for forming an image as claimed in claim 2, wherein the concentration of the bleaching agent in the replenisher having bleaching capacity is 0.005 to 2 mol/liter.

8. The method for forming an image as claimed in claim 2, wherein the aspect ratio of the tabular grains is 2 or more.

9. The method for forming an image as claimed in claim 2, wherein the nuclei contain 2 to 4 gap phases discontinuous in halogen composition.

10. The method for forming an image as claimed in claim 2, wherein the replenisher having a bleaching capacity is a bleaching solution.

11. The method for forming an image as claimed in claim 2, wherein the replenisher having a bleaching capacity is a bleach-fix solution.

12. The method for forming an image as claimed an claim 2, wherein the desilvering step is a bleach-fix step.

13. The method for forming an image as claimed an claim 2, wherein the diameter of the tabular silver halide grains is 10 μm or less.

14. The method for forming an image as claimed in claim 2, wherein the thickness of the tabular silver halide grains is 0.7 μm or less.

15. The method for forming an image as claimed in claim 2, wherein the grain size distribution of the tabular silver halide grains is monodisperse.

* * * * *